US008998555B1

(12) United States Patent
Ingham

(10) Patent No.: US 8,998,555 B1
(45) Date of Patent: Apr. 7, 2015

(54) LIGHTWEIGHT WASTE GATHERING AND DISPOSAL VEHICLE WITH AUTOMATED ARM

(71) Applicant: Little Giant Refuse Vehicle, LLC, Mesa, AZ (US)

(72) Inventor: James P. Ingham, Mesa, AZ (US)

(73) Assignee: Little Giant Refuse Vehicle, LLC, Mesa, AZ (US)

( * ) Notice: Subject to any disclaimer, the term of this patent is extended or adjusted under 35 U.S.C. 154(b) by 154 days.

(21) Appl. No.: 13/661,531

(22) Filed: Oct. 26, 2012

Related U.S. Application Data

(63) Continuation-in-part of application No. 12/177,826, filed on Jul. 22, 2008, now abandoned, which is a continuation-in-part of application No. 11/382,194, filed on May 8, 2006, now abandoned.

(60) Provisional application No. 60/678,719, filed on May 6, 2005.

(51) Int. Cl.
*B65F 3/02* (2006.01)

(52) U.S. Cl.
CPC ..... *B65F 3/0203* (2013.01)

(58) Field of Classification Search
USPC ..... 414/404, 406, 408, 546, 547, 550, 555
See application file for complete search history.

(56) References Cited

U.S. PATENT DOCUMENTS

| | | | | |
|---|---|---|---|---|
| 1,066,977 | A | | 7/1913 | Attaway |
| 2,626,069 | A | | 1/1953 | Jones |
| 2,933,210 | A | | 4/1960 | Dye |
| 3,155,251 | A | | 11/1964 | Williamson |
| 3,174,636 | A | | 3/1965 | Dempster |
| 3,207,344 | A | | 9/1965 | Clar |
| 3,447,705 | A | | 6/1969 | Stone |
| 3,604,577 | A | | 9/1971 | Heilmeier |
| 3,650,421 | A | * | 3/1972 | Miller ..... 414/543 |
| 3,762,586 | A | | 10/1973 | Updike |
| 3,765,554 | A | * | 10/1973 | Morrison ..... 414/408 |
| 3,883,009 | A | | 5/1975 | Swoboda, Jr. et al. |
| 4,091,943 | A | | 5/1978 | Bay-Schmith |
| 4,128,182 | A | | 12/1978 | Pickrell |
| 4,278,390 | A | | 7/1981 | Ahearn |
| 4,281,956 | A | | 8/1981 | Pickrell |
| 4,552,501 | A | | 11/1985 | Clark et al. |
| 4,817,537 | A | | 4/1989 | Cripe et al. |
| 4,930,972 | A | | 6/1990 | Little |
| 5,074,740 | A | * | 12/1991 | Weigel ..... 414/550 |
| 5,138,742 | A | | 8/1992 | Charky |
| 5,215,423 | A | | 6/1993 | Schulte-Hinsken et al. |
| 5,287,684 | A | | 2/1994 | Beroth |
| 5,584,646 | A | * | 12/1996 | Lewis et al. ..... 414/738 |
| 5,711,543 | A | | 1/1998 | Stokes |

(Continued)

*Primary Examiner* — Kaitlin Joerger
(74) *Attorney, Agent, or Firm* — Booth Udall Fuller, PLC

(57) ABSTRACT

A lightweight waste gathering vehicle is used to automate trash collection and removal from soft landscapes within recreation venues minimizing or eliminating damage to landscape. The lightweight vehicle can be used in crowded areas or areas where height, width and/or weight restrictions prevent the use of large refuse trucks. The lightweight waste gathering vehicle includes an automated arm, a tow-behind trailer and turf tires. In one implementation, the automated arm includes a lift arm type system. In another implementation, the automated arm includes a transport rail type system where the grabbers are mounted to a carrier and the carrier is mounted to a transport rail.

9 Claims, 20 Drawing Sheets

(56) References Cited

U.S. PATENT DOCUMENTS

| | | | | | |
|---|---|---|---|---|---|
| 5,720,589 | A | * | 2/1998 | Christenson et al. | 414/408 |
| 5,762,461 | A | | 6/1998 | Frohlingsdorf | |
| 5,769,594 | A | * | 6/1998 | Kalua | 414/543 |
| 5,833,429 | A | * | 11/1998 | McNeilus et al. | 414/408 |
| 5,899,956 | A | | 5/1999 | Chan | |
| 5,934,858 | A | * | 8/1999 | Christenson | 414/408 |
| 6,010,294 | A | | 1/2000 | Lyddon | |
| 6,129,226 | A | | 10/2000 | Donovan | |
| 6,183,185 | B1 | | 2/2001 | Zanzig et al. | |
| 6,276,888 | B1 | | 8/2001 | Rubio | |
| 6,350,098 | B1 | * | 2/2002 | Christenson et al. | 414/408 |
| 6,779,570 | B2 | * | 8/2004 | Tardif | 144/4.1 |
| 6,881,021 | B1 | * | 4/2005 | Winter et al. | 414/420 |
| 8,092,141 | B2 | * | 1/2012 | Curotto et al. | 414/408 |
| 8,313,584 | B1 | * | 11/2012 | Szabo | 134/169 R |
| 2003/0082037 | A1 | | 5/2003 | Khodkov | |

* cited by examiner

FIG. 20 C
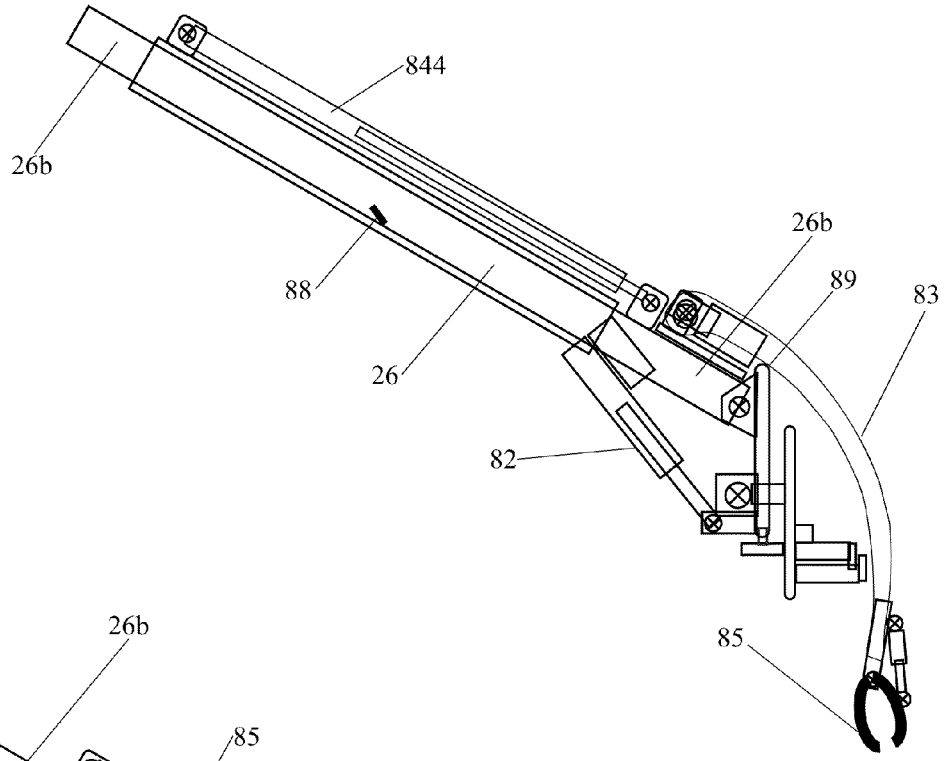
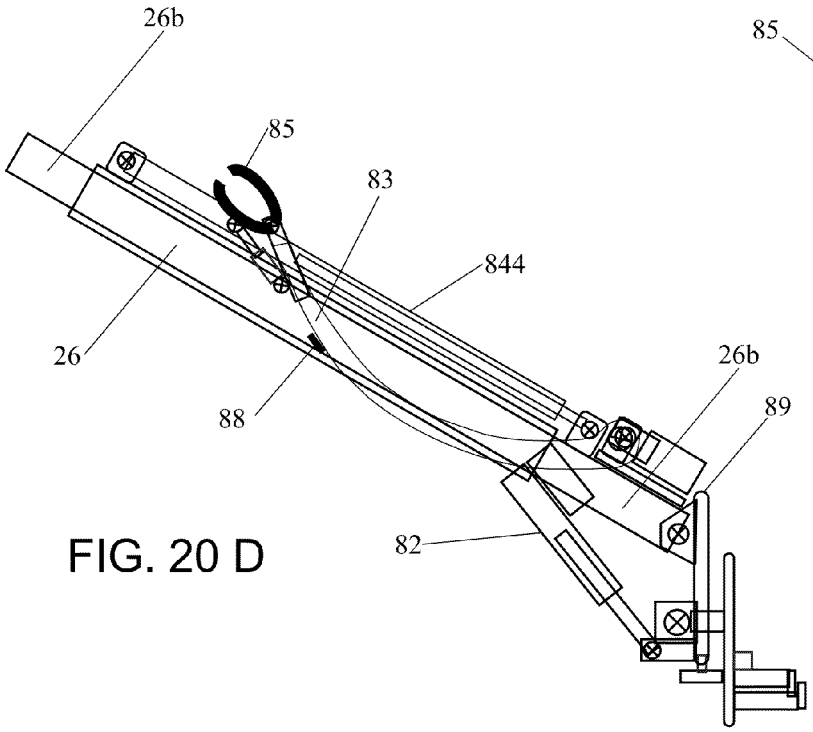
FIG. 20 D

LIGHTWEIGHT WASTE GATHERING AND DISPOSAL VEHICLE WITH AUTOMATED ARM

CROSS-REFERENCE TO RELATED APPLICATIONS

This application is a Continuation-in-Part application of currently pending U.S. patent application Ser. No. 12/177,826 to James Ingham titled "LIGHTWEIGHT WASTE GATHERING AND DISPOSAL VEHICLE WITH AUTOMATED ARM," filed Jul. 22, 2008, which application is a Continuation-in-Part application to U.S. patent application Ser. No. 11/382,194 to James Ingham titled "LIGHTWEIGHT WASTE GATHERING AND DISPOSAL VEHICLE WITH ROBOTIC ARM," filed May 8, 2006, which application claims the benefit of the filing date of U.S. Provisional Patent Application No. 60/678,719, entitled "Lightweight Waste Gathering and Disposal Vehicle with Robotic Arm" to James Ingham which was filed on May 6, 2005, the disclosures of which are hereby incorporated herein by reference.

BACKGROUND

1. Technical Field

Aspects of this disclosure relate generally to a lightweight waste gathering vehicle that is capable of traveling over landscaped surfaces and through narrow passages while gathering waste from garbage cans or other waste collection containers. More specific implementations of a waste gathering vehicle include a lightweight vehicle with an exceptional tow-behind trailer and a automated lift arm or rail designed to grab garbage cans or barrels and empty the waste contents into the trailer.

2. Background Art

Conventional garbage trucks with robotic lift arms are too large and heavy to be used in recreational venues, such as golf courses, public parks, campgrounds, lakes or other private parks such as amusement parks and sporting arenas. These types of venues typically have soft landscape surfaces, compact areas to maneuver around, and/or narrow passageways. Waste gathering and removal from venues such as these is performed by hand with two or more workers removing refuse bags from garbage cans.

There are several problems associated with this manual method of waste collection. For example, back head and neck injuries, very time consuming, costly, exposes the workers to potential biohazards and other injuries, and it has a negative environmental impact due to the use of plastic can liners. Therefore, a need exists for an automated method of waste removal in recreational venues that will minimize or eliminate damage to delicate landscape and can safely be utilized in crowded areas.

SUMMARY

Industry has no automated method of waste gathering and disposal on soft surface areas in public venues. Waste gathering is a physical process requiring the use of a plastic bag/liner inserted into the trash receptacle which aides in the 3 removal and disposal of waste.

Certain implementations of this waste gathering and disposal method contain a base vehicle smaller in size, weighting less, and having more maneuverability creating greater versatility and enabling access onto soft surfaces, yet still with automated collection capability previously believed not possible for such a small vehicle. Certain implementations of a waste gathering and disposal vehicle involve an automated method for waste gathering that can safely be utilized in recreational venues where crowds of people may be present. Certain implementations provide an automated method for waste gathering that will not damage soft landscapes and can be used in areas where there may be height, width and weight restrictions that prevent the use of large refuse trucks.

The use of implementations of lightweight waste gathering vehicles reduce manual labor involved with waste collecting and removal in recreational venues, thus reducing time, cost and worker injuries, and increasing productivity. Because particular implementations of a waste gathering vehicle the use of plastic garbage can liners can be reduced or eliminated, thereby reducing cost and environmental impact.

A specific implementation of a lightweight waste gathering and disposal system includes a lightweight waste gathering vehicle that includes a specialized trailer, an automated lift arm and turf tires. Such a vehicle can safely be utilized in recreational venues for waste removal without causing damage to landscaping while increasing worker productivity and decreasing worker injuries and exposure to potential bio hazards. One particular implementation includes a lift arm type system. Another particular implementation includes a transport rail type system.

The present disclosure relates, among other things, to a refuse receptacle emptying apparatus for use with a utility vehicle which may comprise a platform configured to couple to a utility vehicle, a turret rotatably coupled to the platform, the turret responsive to a turret actuator coupled to the turret and the platform that rotates the turret between a first position and a second position, a fulcrum element pivotally coupled to the turret, a substantially hollow lift arm coupled to the fulcrum element, the fulcrum element positioned between a first end of the lift arm and a second end of the lift arm such that when the first end of the lift arm is lowered the fulcrum element pivots to raise the second end of the lift arm and when the first end of the lift arm is raised the fulcrum element pivots to lower the second end an extendable lift cylinder pivotally coupled to the turret and pivotally coupled proximate the first end of the lift arm, the extendable lift cylinder configured to raise the first end of the extension arm relative to the platform when extended and lower the first end of the extension arm relative to the platform when retracted, a telescoping extension arm slidably coupled at least partially within the lift arm and extendable from the second end of the lift arm responsive to an extension cylinder coupled to the extension arm and the lift arm, and a grabber pivotally coupled to the extension arm.

Particular embodiments may comprise one or more of the following. The extension arm may extend and retracts at least partially within the lift arm responsive to a extension cylinder that extends into the second end of the lift arm. The grabber may be coupled to a grabber backing plate pivotally coupled to the extension arm. The extendable lift cylinder may be pivotally coupled to the turret proximate the platform. The actuator may be pivotally coupled to the platform and pivotally coupled to the turret. The grabber may comprise two curved grabber elements each movable coupled to the grabber plate. A bag collector arm pivotally coupled to the extension arm and responsive to a bag collector motor to pivot between a retracted collector arm position and an extended collector arm position. A sanitizer spraying element coupled the grabber backing plate. A receptacle leveling actuator coupled to the grabber backing plate.

The present disclosure also relates to, among other things, a refuse receptacle emptying apparatus for use with a utility vehicle which may comprise a platform configured to couple to the utility vehicle, the platform comprising a first side, a second side adjacent the first side, a third side adjacent the second side and opposite the first side, and a fourth side adjacent the first and third sides and opposite the second side, a first rail support coupled to the platform, a second rail support coupled to the platform, a curved transport rail coupled to the first rail support and the second rail support, the curved transport rail comprising a first end positioned proximate the first side of the platform and a second end raised above the platform relative the first end and positioned proximate the fourth side, a transport rail extension hingedly coupled to the second end of the transport rail, the transport rail extension pivotal between a folded position and an extended position responsive to an actuator, and a grabber movable coupled to at least one of the transport rail and the transport rail extension, the grabber movable between a first position proximate the first end of the transport rail and a second position proximate a terminating end of the transport rail extension when the transport rail extension is in a extended position.

Particular embodiments may comprise one or more of the following. The transport rail may be pivotally mounted to the second rail support, and the first rail support comprises a first extension cylinder configured to move the first end of the transport rail closer to and further from the first side of the platform. The second end of the transport rail may be positioned between the first and the third sides of the platform proximate a plane formed by the fourth side of the platform. The grabber may comprise two curved grabber elements each movable coupled to the grabber plate. A sanitizer spraying element coupled the grabber backing plate.

The present disclosure also relates, among other things, to a utility vehicle for gathering refuse from refuse receptacles which may comprise a utility vehicle chassis comprising a width less than about 72 inches, four tires, at least two of them steerable, comprising a width greater than about 12 inches, each of the four steerable tires operably coupled to the utility vehicle chassis, the vehicle comprising a vehicle length of between about 80 inches and 130 inches, and a gross vehicle weight of less than about 4200 pounds, a platform coupled the vehicle chassis, the platform comprising a first side, a second side adjacent the first side, a third side adjacent the second side and opposite the first side, and a fourth side adjacent the third and first sides and opposite the second side, an arm coupled to platform, the arm comprising a grabber movable between a first position proximate the first side of the platform and a second position past the fourth side of the platform, the grabber configured to grip a refuse receptacle having a capacity between approximately 30 and 60 gallons.

Particular embodiments may comprise one or more of the following. A trailer coupled to the platform proximate the fourth side of the platform, wherein when the grabber is in the second position the grabber is positioned over the trailer. The trailer may comprise a chassis comprising a roller track and lift arms configured to grip a dumpster and draw the dumpster into the trailer across the roller track for transport to a different location. The arm may comprise a lift arm and the vehicle may further comprise a turret rotatably coupled to the platform, a fulcrum element pivotally coupled to the turret and coupled to the lift arm between a first end of the lift arm and a second end of the lift arm such that when the first end of the lift arm is lowered the fulcrum element pivots to raise the second end of the lift arm and when the first end of the lift arm is raised the fulcrum element pivots to lower the second end, an extendable lift cylinder pivotally coupled to the turret and pivotally coupled proximate the first end of the lift arm, the extendable lift cylinder configured to raise the first end of the extension arm relative to the platform when extended and lower the first end of the extension arm relative to the platform when retracted, and an extension arm slidably coupled to the lift arm and extendable from the second end of the left arm, wherein the grabber is pivotally coupled to the extension arm and the turret is responsive to a turret actuator coupled to the turret and the platform to rotates the grabber between the first position and the second position. The extendable lift cylinder may be pivotally coupled to the turret proximate the platform and the turret actuator is pivotally coupled to the platform and pivotally coupled to the turret. The arm may comprise a curved transport rail comprising a first end proximate the first side of the platform and a second end raised above the platform relative the first end and positioned proximate the fourth side, the vehicle may further comprise a first rail support extensions cylinder coupled to the platform and the curved transport rail and configured to move the first end of the curved transport rail further from and closer to the first side, a second rail support coupled to the platform and the curved transport rail, and a transport rail extension hingedly coupled to the second end of the transport rail, the transport rail extension pivotal between a folded position and an extended position responsive to an actuator, wherein the grabber is movable along the transport rail and the transport rail extension between the first position proximate the first end of the transport rail and the second position proximate a terminating end of the transport rail extension when the transport rail extension is in a extended position.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations of a lightweight waste gathering vehicle will hereinafter be described in conjunction with the appended drawings, where like designations denote like elements, and:

FIG. 20C is a side view of an automated arm; and

FIG. 20D is a side view of the lift arm.

DESCRIPTION

Figure 1:
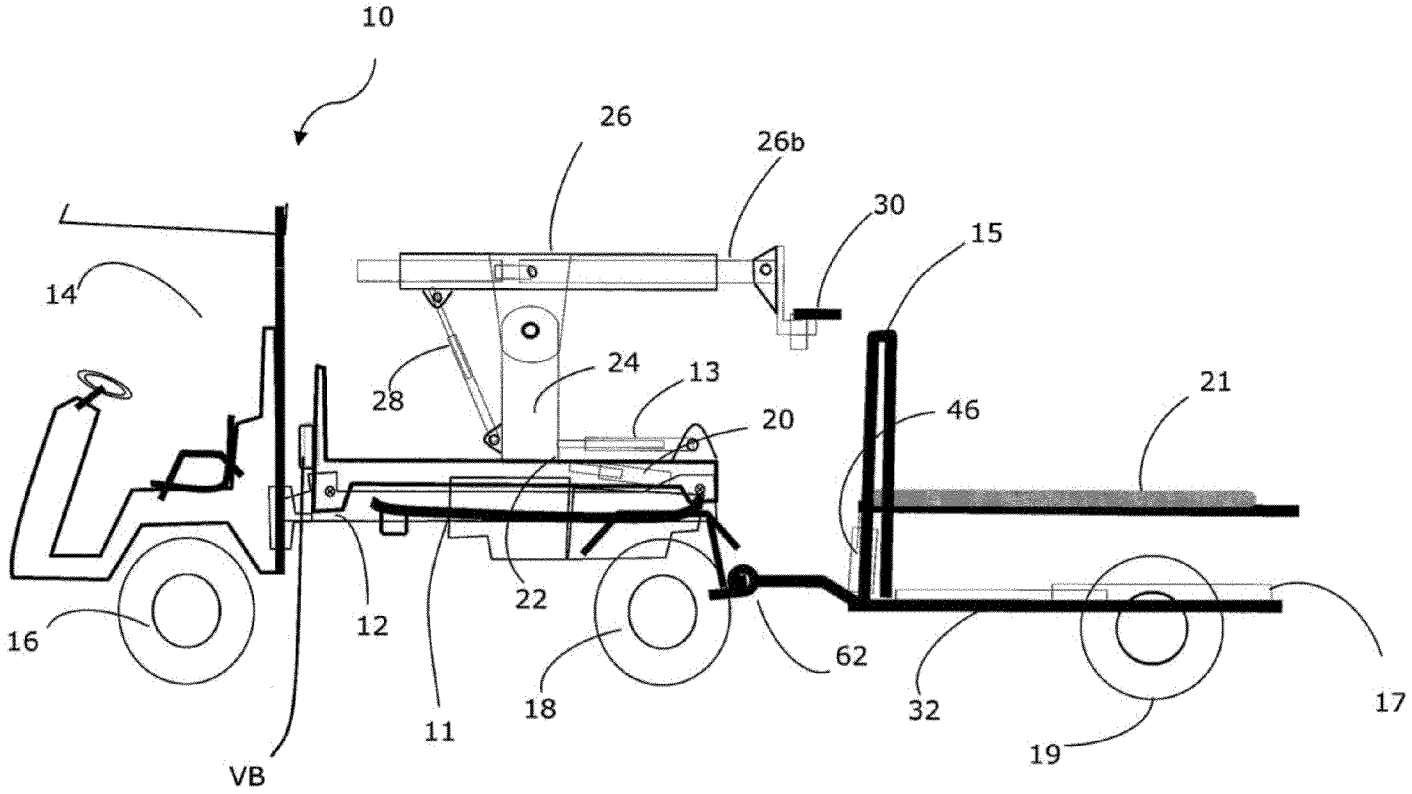
FIG. 1 is a side view of a waste collecting vehicle with a lift arm system.

This disclosure, its aspects and implementations are not limited to the specific components, methods and assembly procedures disclosed herein. Many additional components, methods and assembly procedures known in the art consistent with the intended vehicle and waste gathering methods will become apparent for use with implementations of the vehicle and waste gathering methods from this disclosure. Accordingly, for example, although particular hardware is disclosed, such hardware and implementing components may comprise any size, shape, style, type, model, version, measurement, concentration, material, quantity and/or the like as is known in the art for such hardware and implementing components, consistent with the intended vehicle and waste gathering methods. The disclosure is not limited to use of any specific components, provided that the components selected are consistent with the intended vehicle and waste gathering methods.

Generally, a lightweight vehicle for waste collection in recreational venues includes a automated lift arm, a unique tow behind trailer and turf tires. Implementations are operable by a single operator, thus minimizing the current operation procedures that require two or more workers to physically attend to trash collection duties. In operation, the vehicle is positioned so that a light refuse trash receptacle is near one side of the vehicle. The automated arm includes grabbers that are designed to grab a light refuse trash receptacle. As used herein, "light refuse trash receptacles" include those trash receptacles having a capacity of less than approximately 90 gallons. Most often used in golf courses and recreational parks are the receptacles having a capacity of between approximately 30 gallons to 60 gallons. Lifting the trash receptacle the automated arm transports then tilts the trash receptacle so as to dump the contents of the trash receptacle into the tow behind trailer. The automated arm then returns the empty trash receptacle to substantially its original position near the side of the vehicle.

In a particular implementation shown in FIGS. 1-4, the waste gathering vehicle 10 includes a chassis 12, a cab 14 for housing controls and the operator, front tires 16 and rear tires 18. The vehicle chassis 12 and cab 14 shown in the various Figures of this disclosure are representative of a lightweight utility vehicle such as that manufactured by Toro or John Deere and others. Such vehicles are designed for maintenance use in small areas such as parks, recreational locations, theme parks, golf courses, and the like, where pathways are narrow, pedestrians are often walking, noise is a concern, and conventional large trucks cannot travel.

Vehicles for use in implementations of the present disclosure include those having an overall width not greater than about 72 inches, and preferably between about 48 inches and about 60 inches; having a wheel base no greater than about 72 inches, and preferably between about 45 and 70 inches; having a vehicle overall length no greater than about 140 inches and preferably between about 80 inches to about 130 inches; and having a gross vehicle weight of no greater than about 6000 pounds, and preferably between about 2000 lbs and about 4200 lbs. In a particular embodiment, the weight is approximately 4500 lbs and the width is approximately 40 inches. For a perspective comparison, a lightweight vehicle for use with particular implementations may be smaller than a conventional quarter ton (¼) truck. In a specific embodiment, the vehicle comprises a chassis width of approximately 40 inches.

While these vehicles are conventionally not street certified, they typically are manufactured to meet the California Air Resources Board (CARB) emissions requirements for specialty vehicle engines and EPA regulations. Non-limiting examples of these kinds of lightweight vehicles include the John Deer Pro Gator Models 2020 and 2030 Utility Vehicle (2 or 4 wheel drive) and the Toro Workman 3000 and 4000 Series Utility Vehicle (2 or 4 wheel drive). The vehicles are full framed vehicles that include a vehicle chassis, different from typical golf cart-type unibody vehicles with no chassis. The chassis may include high strength steel channels in the full frame under carriages. Corrosion protection through powder coating may be implemented, and sharp edges and corners of the body may be smoothed. Unlike conventional residential refuse collection vehicles, vehicles configured as described above do not require a commercial driver's license to operate them.

The front tires 16 and the rear tires 18 of this implementation, though not required for every implementation, are turf tires. Turf tires are wide, balloon style tires that distribute a vehicle's weight over a large area and minimize damage to lawns and soft soil. There are standard turf tires, extra-wide turf tires called floatation tires, and combination turf tires that combine the balloon design of turf tires for lawn protection with heavier materials for puncture resistance and better traction. The use of turf tires may minimize or eliminate damage to soft landscape such as may be found in a public park, on a golf course, or other area with ground foliage. Examples of companies that manufacture turf tires include, without limitation, Firestone Agricultural Tire Company, and the Carlisle Tire and Wheel Company. The front tires 14 and the rear tires 16 may be of the same size or different size depending upon the vehicle. One specific example of tire sizes found to be advantageous uses front tires that are 20×10-10 with a 4-ply rating and turf tread; and rear tires that are 24×12-12 with a 6-ply rating and turf tread. For the size and weight of lightweight vehicles disclosed for various implementations throughout this disclosure, tires having a width of about 8 inches to about 28 inches are believed to be most advantageous for minimizing landscape damage and minimizing overall vehicle width. Turf tires conventionally have a width of about 12 inches to about 28 inches for this size of vehicle.

Two rub rails 11 as shown in more detail in FIG. 1 are secured to chassis 12. An actuator 13 and rotate cantilever turret 24 on a fitted bearing 22, which is mounted to platform 20, are secured to chassis 12. Manufacture of the vehicle may be performed at one location or portions, such as the turret-platform component, may be manufactured at one location and later coupled to the vehicle chassis. The turret lift arm 26 houses and controls an extension arm 26*b* and a lift cylinder 28. For this particular implementation, the turret arm base has a rotation range of 200 degrees and the arm has a rotation range of 40 degrees up and 30 degrees down from horizontal. Different rotation angles and ranges are contemplated and these numbers are provided as only one non-limiting example. The opposite end of the extension arm 26*b* includes the grabbers 30. A distinctive tow behind trailer 32 is attached to the rear of the chassis 12. The tires 19 on the trailer 32 for this particular implementation are also turf tires. Particular components of the vehicle 10 used for this implementation will be discussed in further detail below.

Figure 4:
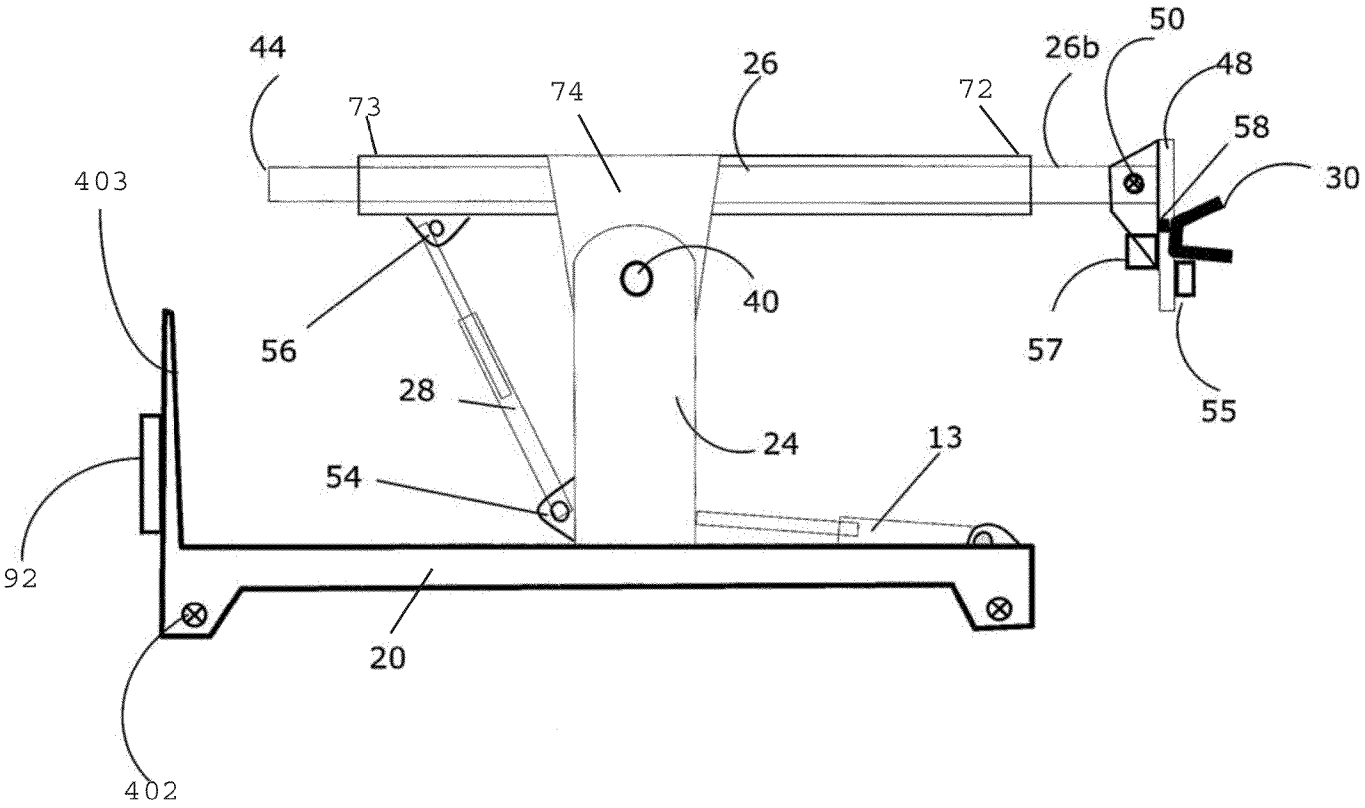
FIG. 4 is a detailed side view of the lift arm system.
Figure 5:
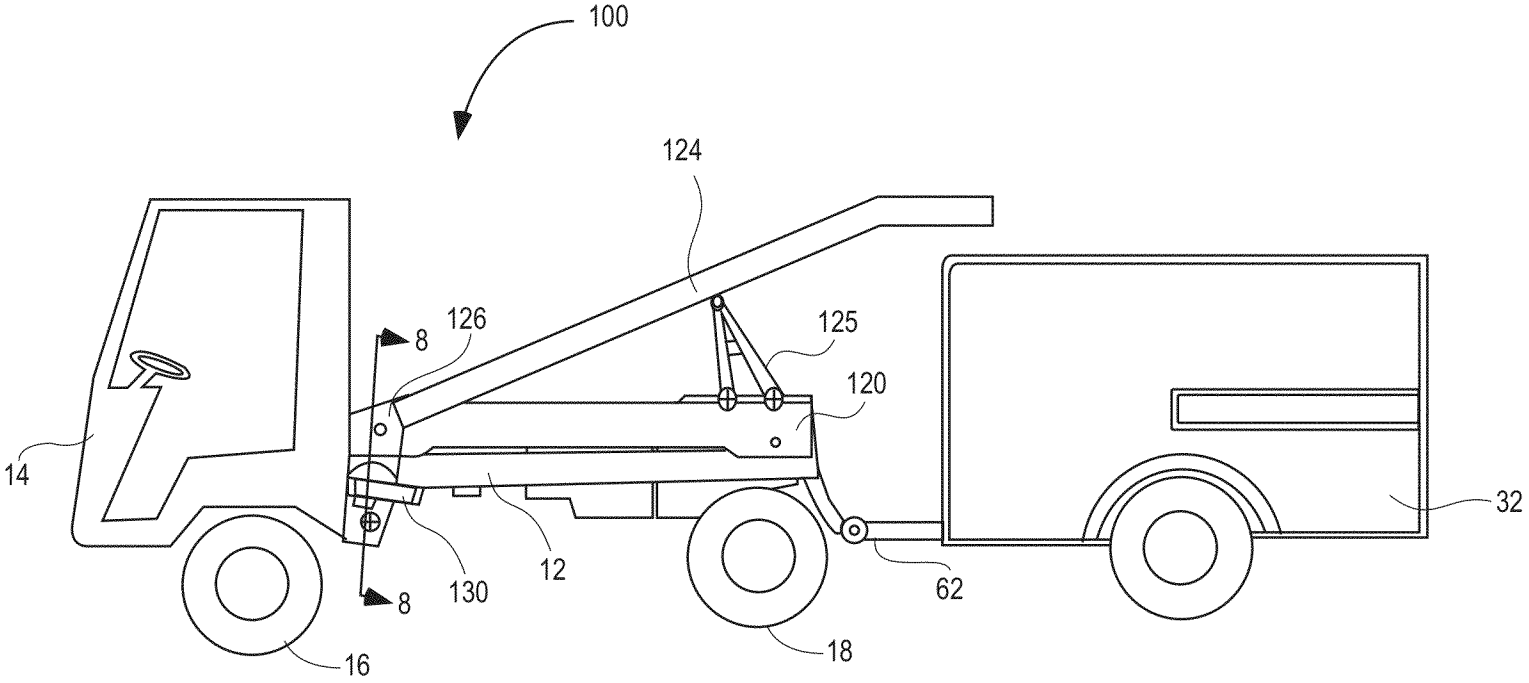
FIG. 5 is a side view of a waste collecting vehicle with a transport rail system.

The cantilever automated arm assembly of this implementation is shown in more detail in FIG. 4. The lift arm 26 is mounted to the turret 24 at pivot point 40. In the particular embodiment shown in FIG. 4, the lift arm 26 is coupled to a fulcrum element 74, which is pivotally coupled to the platform 20. Fulcrum element 74 is typically positioned on the lift arm 26 between a first end 73 of the outer extension arm 26 and a second end 72 of the lift arm 26. Pivotal coupling of the fulcrum element 74 to the turret 24 allows the first end 73 to lower when the second end 72 is raised (relative to platform 20). Likewise, the pivotal coupling of the fulcrum element 74 to the turret 24 allows the second end 72 to lower when the first end 73 is raised (relative to platform 20).

Pivoting of the lift arm 26 is caused, in some implementations, by lift cylinder 28, as described elsewhere in this document. Extension and retraction of lift cylinder 28 is typically responsive to user controls, such as but not limited to hydraulic component 92. When extended, lift cylinder 28 raises the first end 73 of lift arm 26 relative to platform 20, thus lowering the second end 72. Similarly, when retracted, lift cylinder 28 lowers the first end 73 of lift arm 26 relative to platform 20, thus raising second end 72.

The lift arm 26 includes an extension arm 26*b* that can be extended from the lift arm 26 by using an extension cylinder 44 or other known articulation methods. In various embodiments, the extension arm 26*b* is slidably coupled to the lift arm 26. The extension arm of this non-limiting example includes an extension length of greater than about 30 inches. In some embodiments, lift arm 26 comprises an outer arm, and extension arm 26*b* comprises an inner extension arm that fits at least partially within lift arm 26. For example, embodiments similar to that shown in FIGS. 20A-D comprise an extension arm 26*b* that extends all the way through lift arm 26. Extension cylinder 844 is coupled to at least one point on the exterior of lift arm 26 and also coupled to at least one point on of extension arm 26*b*. Thus, as extension cylinder 844 extends or retracts, extension arm 26*b* slides at least partially through lift arm 26. In such an embodiment, lift arm 26 is substantially hollow and allows for passage of extension arm 26*b* through the hollow portion of lift arm 26. In this way, lift arm 26 and extension arm 26*b* comprise a telescoping arm system.

Figure 10A:
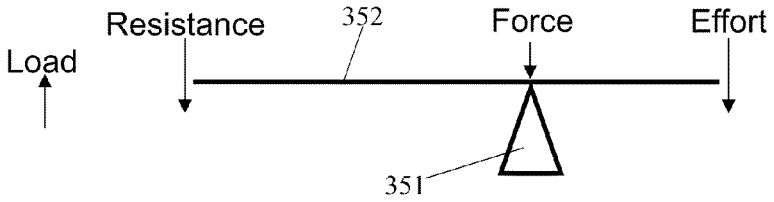
FIG. 10A is an exemplary block diagram of a fulcrum system.

FIGS. 10B-E are exemplary block diagrams illustrating the different forces and reactionary force present when an automated arm assembly, such as that shown in FIG. 4 is utilized. FIG. 10A illustrates a fulcrum system. In order to lift a Load up on one side of arm 352, an Effort is required on the opposing side in a downward direction. Resistance, due to gravity, also acts on the side of the Load. As the Effort is exerted downward to lift the Load upward, a Force acts on the fulcrum 351 at the point of contact between the fulcrum 351 and the arm 352.

FIG. 10B-E illustrate the effect of introduction of a pivot point 354 to the system. Pivot point 354 is, in some embodiments, similar to pivot point 40 shown in FIG. 4. In FIG. 10B-E, the system also includes an inverted fulcrum element 353 and a base element 354. In some embodiments, inverted fulcrum element 353 is similar to fulcrum element 74, base 355 is similar to turret 24, and arm 352 is similar to lift arm 26 and/or extension arm 26*b*. Thus, the effect of elements shown in FIGS. B-E may be applied to various embodiments of the apparatus illustrated in FIG. 4.

Figure 10B:
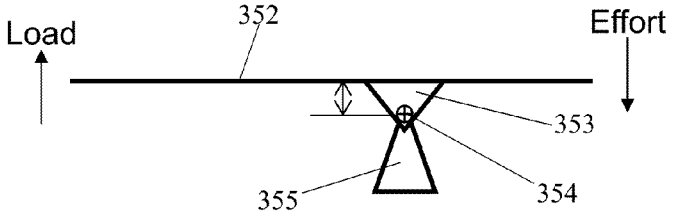
FIGS. 10B-E are exemplary block diagrams of various forces and reactionary forces in an automated arm assembly.

With specific reference to FIG. 10B, to lift the Load upward on one side of arm 352, and downward Effort is required on the opposing side of arm 352. Inverted fulcrum element 353 distributes the force acting on arm 352 across the entire area of inverted fulcrum 353 in contact with arm 352. The force is further distribute through to the base 355 at pivot point 354.

Figure 10C:
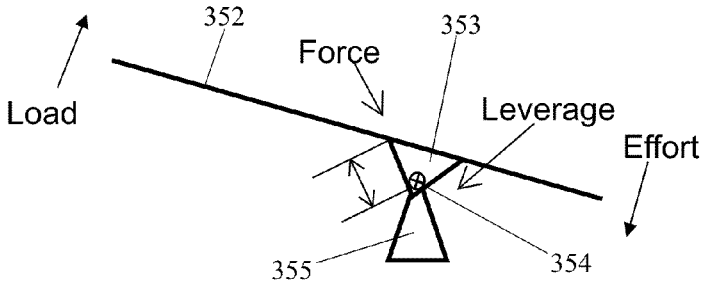
Figure 10D:
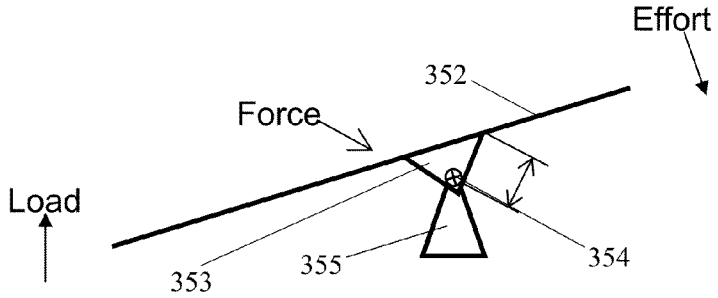
Figure 10E:
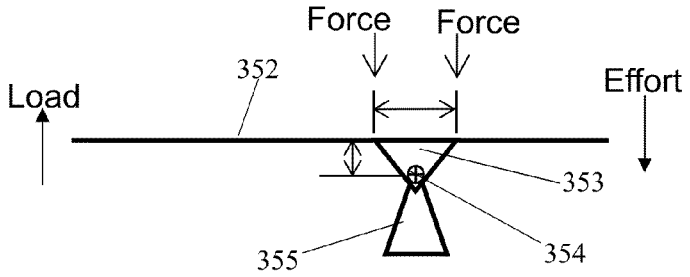

With specific reference to FIG. 10C-E, as the downward Effort lowers one side, the Load on the opposing side of arm 352 is raised. In contrast to previous systems, however, the combination of the inverted fulcrum element 353, the pivot point 353, and the base 355 act together to provide Leverage that allows for easier lifting of the Load.

Figure 12A:
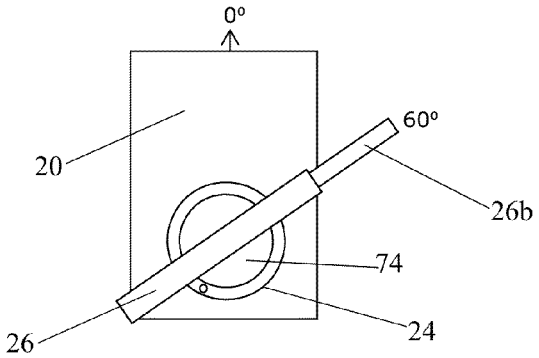
FIGS. 12-A-E are top views of various angles of lift arm rotation.
Figure 12B:
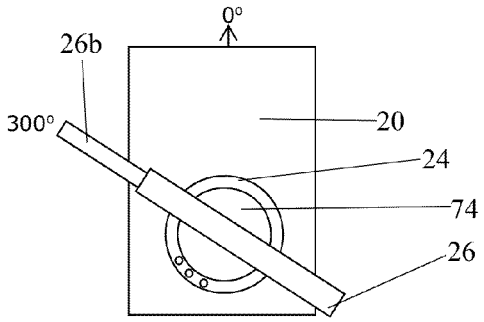
Figure 12C:
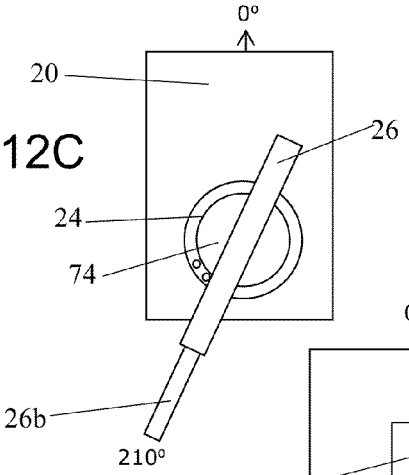
Figure 12D:
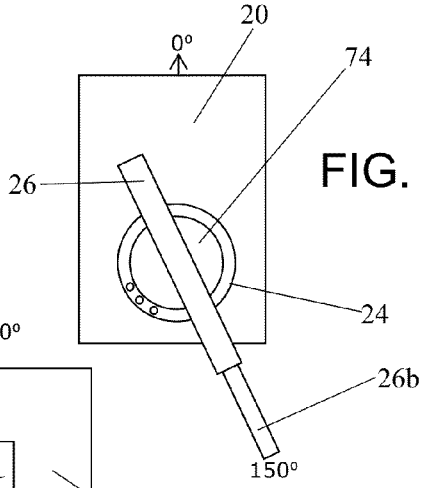
Figure 12E:
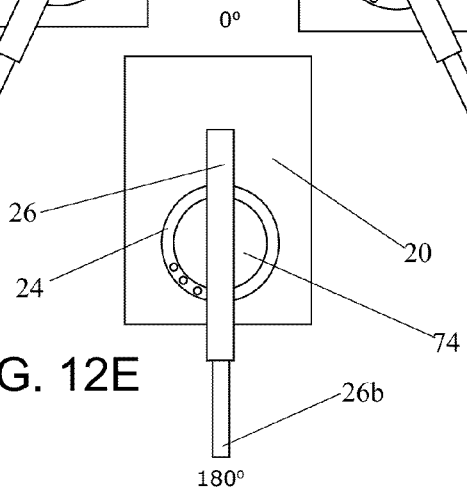

On the distal end of the extension arm 26*b*, opposite the end proximate the turret 24, is attached a grabber backing plate 48. The grabber backing plate 48 is attached to the extension arm 26*b* at pivot point 50. The grabbers 30 are secured by actuator 55. Dump motor 57 is attached to actuator 55, which operates grabbers 30. The grabbers 30 may be moved between the open position and the closed position through a pivot point. The grabbers of this non-limiting example have an open/close range of +/−90 degrees each and a wrist roll rotation range of +/−190 degrees. In various embodiments, grabber 30 is configured to grab receptacles 72 with a radius between approximately nineteen and twenty-four inches. The lift cylinder 28 is attached to the turret 24 at pivot point 54 and to the extension arm 26 at pivot point 56. Using hydraulic power with an 8 to 10 gallons per minute pump, an auxiliary hydraulic reservoir and an auxiliary cooler and electric fan, the automated arm can achieve a 200 degree rotation about the turret in about 4 seconds and a full rotation in less than 10 seconds; 70 degree pivot up or down in less than 4 seconds; 36 inches of full arm extension in less than 8 seconds; 180 degrees of grabber movement from open to closed in less than 3 seconds; and 190 degrees of wrist roll in less than 4 seconds. These rates are provided not as a limitation on any implementation, but to show the capability of one example of an automated arm for use on a lightweight vehicle. Many other automated arm examples could be selected or configured for use with the various implementations discussed herein. Examples of degrees of rotation are shown in FIGS. 12A-12E. In FIG. 12A, turret 24 has rotated lift arm 26 60 degrees. In FIG. 12B, turret 4 has rotated lift arm 26 300 degrees. In FIG. 12C, turret 24 has rotated lift arm 26 210 degrees. In FIG. 12D, turret 24 has rotated lift arm 26 150 degrees. And in FIG. 12E, turret 24 has rotated lift arm 26 180 degrees. The rotational movement of turret 24 allows lift arm 26 to move transitionally to grab receptacle 72 with grabbers 30, move the receptacle over a dumpster, a trailer, or a dumpster in a trailer behind the platform 20, then dump the refuse in the receptacle 72 into the dumpster or trailer. Movement may be between any of the positions described in FIG. 12 or elsewhere in this document.

In various embodiments, as shown in FIGS. 20A-D, a sanitizer spraying element 81 is coupled to the extension arm 26*b*, lift arm 26, grabber backing plate 48, or grabber 30. In the embodiment shown in FIGS. 20A and B, sanitizer spraying element 81 is coupled to the inner arm 26*b*. A sanitizer line 86 extends from sanitizer spraying element 81 to a sanitizer tank (not shown), such as but not limited to a five-gallon sanitizer tank. The sanitizer line is positioned at various points to the lift arm 26 and extension arm 26*b*. In some embodiments, sanitizer line is made up of either hard-line or flex-line material at various positions between the sanitizer spraying element 81 and the sanitizer tank. Positioning a flex-line area between the lift arm 26 and extension arm 26*b* allows for extension movement. Further, a pump, such as a 12 VDX electric pump may be used to pump sanitizer from the tank to the sanitizer spraying element 81. Sanitizer spraying element 81 is positioned and configured to spray sanitizer into receptacle 72 before, during, or after emptying of the receptacle.

Various embodiments may further comprise a receptacle leveling actuator 82 coupled to the extension arm 26*b*, lift arm 26, grabber backing plate 48, or grabber 30. In the embodiment shown in FIGS. 20C-D, receptacle leveling actuator 82 is coupled to extension arm 26*b*. Receptacle leveling actuator 82 is configured to level the receptacle before, during, and/or after emptying of the receptacle 72. In a particular embodiment, receptacle leveling actuator 82 comprises a hydraulic element.

Figure 20A:
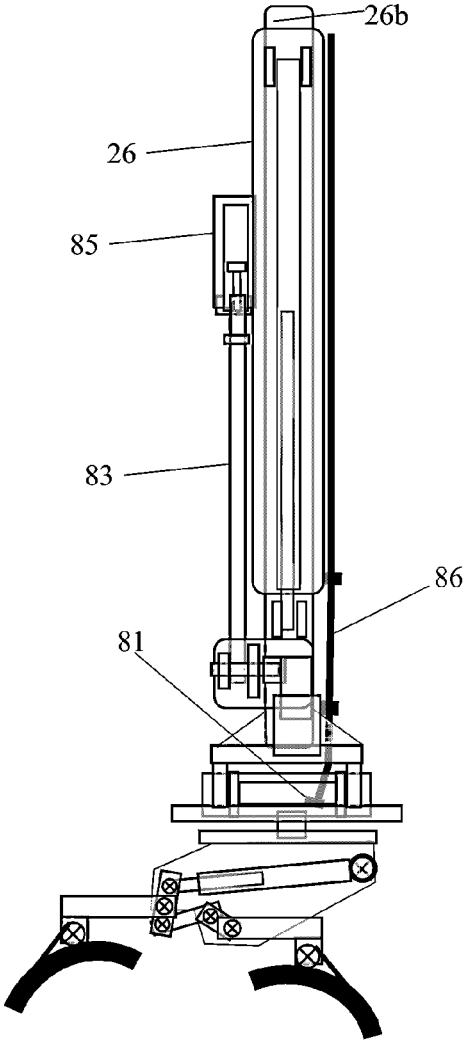
FIG. 20A is top view of a lift arm and extension arm.
Figure 20B:
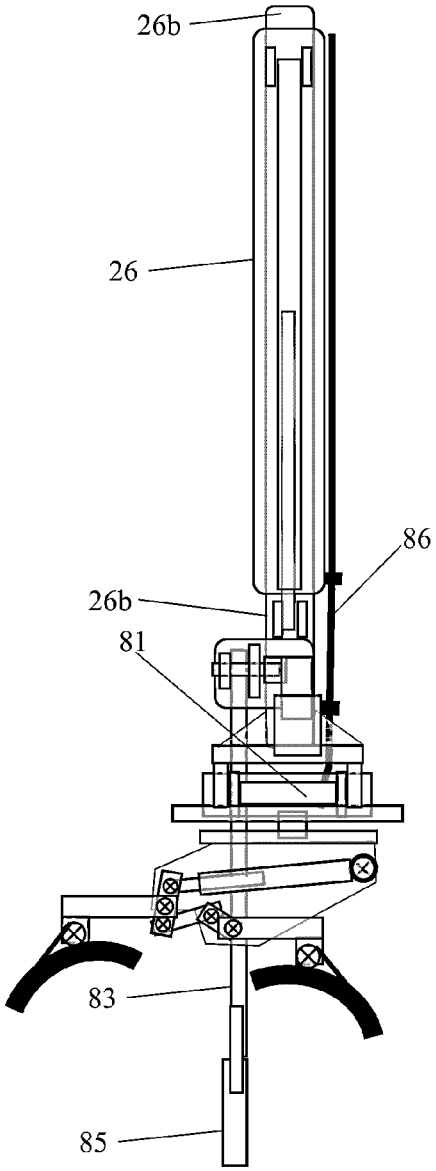
FIG. 20B is a top view of a lift arm and extension arm with an extended grabber arm.

Various embodiments may further comprise a bag collector arm 83 pivotally coupled to the lift arm 26, extension arm 26*b*, grabber backing plate 48, or grabber 30. In the embodiment shown in FIGS. 20A-D, bag collector arm 83 is pivotally coupled to extension arm 26*b*. Bag collector arm 83 is responsive to a bag collector motor 84 and is configured to pick-up a plastic bag or other debris or objects before or after emptying receptacle 72. Bag collector 83 may pick-up a plastic bag or other debris by pinching the plastic bag or debris with pinchers 85. Embodiments may further comprise a first bag collector arm stop 88 positioned on the lift arm 26 and a second bag collector arm stop 89 positioned on the grabber backing plate 48. In FIG. 20C, bag collector arm 83 is in a extended position, while in FIG. 20D, bag collector arm 83 is in a retracted position. Extension and retraction of bag collector arm 83 may be actuator by a variety of mechanisms known in the art.

In some embodiments, lift arm 26 comprises an automated lift arm 26. In combination with the fulcrum element 74, turret 25 and grabber 30, the lift arm is controllable to pick up trash receptacles 72 as well as stand along garbage bags (in certain embodiments).

The unique tow behind trailer, as shown in more detail in FIG. 1, has the capability of loading a conventional dumpster 91 (shown in FIG. 2) onto its chassis. Dumpster 91 may comprise a standard grounded dumpster known in the art. Trailer chassis 32 includes hitch 62 and vertical fork legs 15 secured by a roller track on chassis 32. Actuator 17, moves vertical fork legs 15 by roller track and is secured at the distal end to chassis 32. Dumpster lift arms 21 are attached to fork legs 15 and move up and down by actuator 46. In this way, the tow behind trailer 32 can utilize any conventional dumpster 91 having it serviced by the local solid waste department. In a particular implementation of a tow behind trailer, the bed of the trailer is configured to include a dumpster 91. Hydraulic or pneumatic power may be mounted on a trailer frame beneath the trailer bed which, when activated, extend to lift the dumpster 91 off of the trailer frame. In particular implementations, a proportional hydraulic system may be used for smoother transitions. It is believed that those of ordinary skill in the art will readily be able to adapt the trailer 32 shown in FIGS. 1-3 to operate as a dumpster lift trailer from this description.

Figure 2:
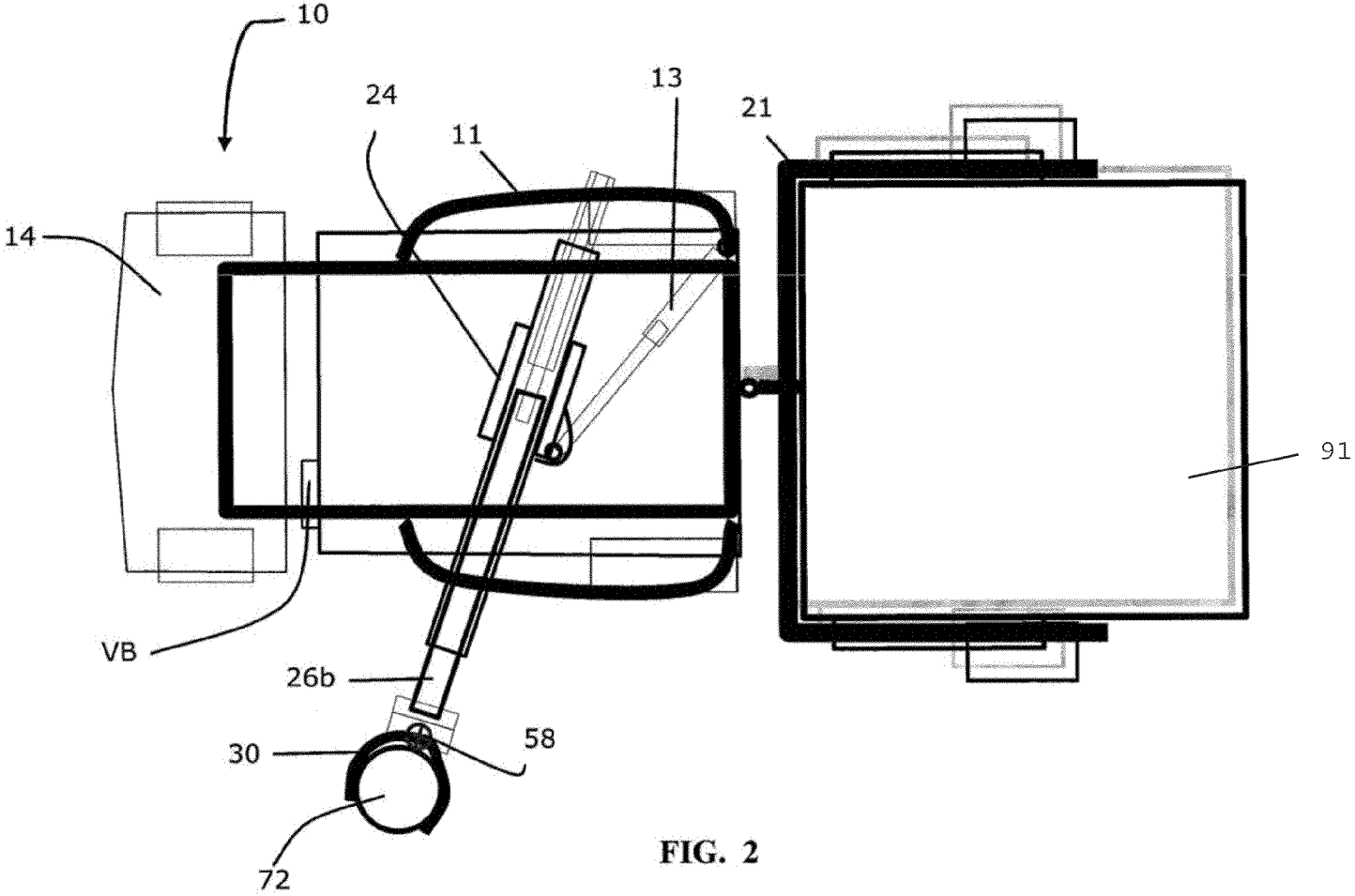
FIG. 2 is a top view of the vehicle from FIG. 1, where the lift arm is in a first position.
Figure 3:
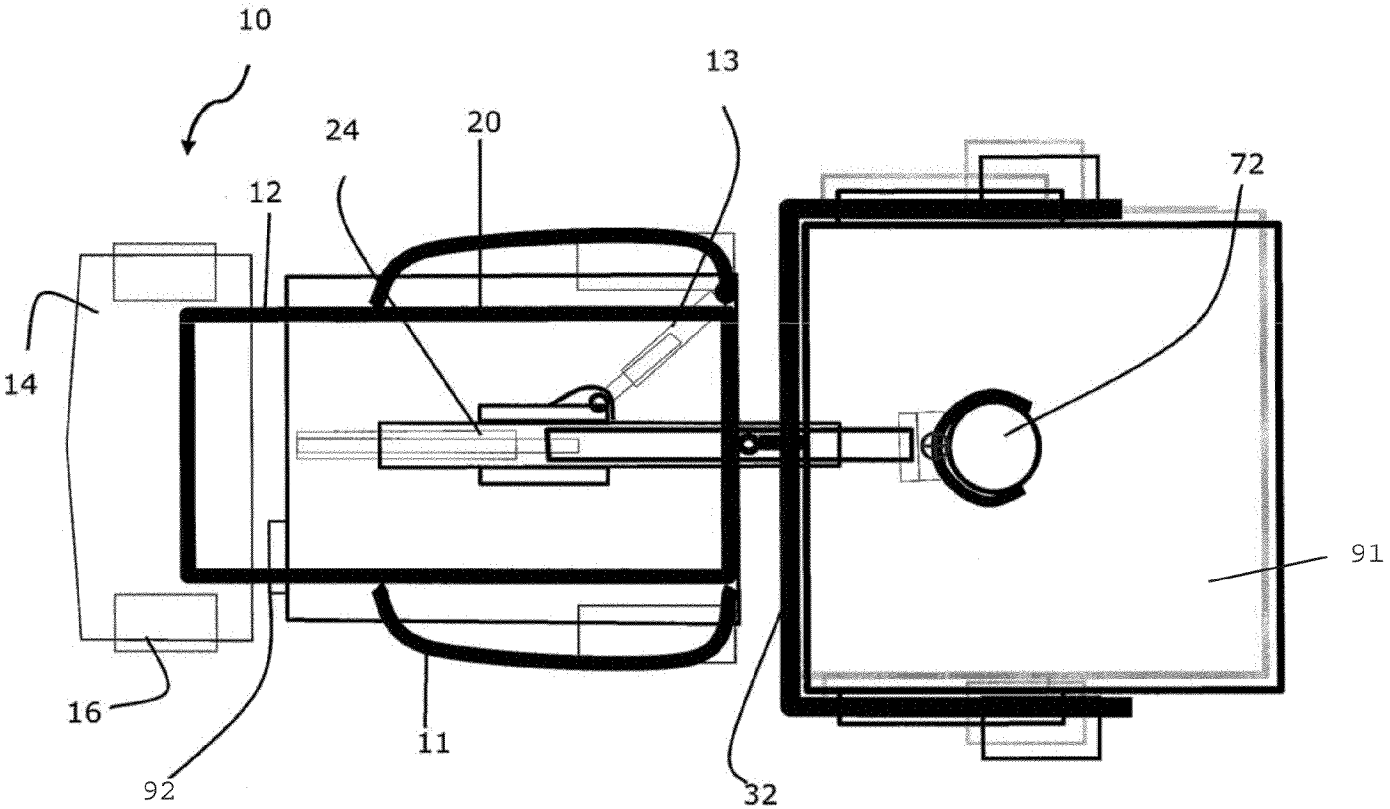
FIG. 3 is a top view of the vehicle from FIG. 1, where the lift arm is in a second position.

In operation, the vehicle 10 may be positioned alongside a trash receptacle 72 (see FIGS. 2 and 3) in a first position. The turret 24 may be rotated and the extension arm 26*b* extended toward the receptacle 72. The grabbers 30 may be closed around the receptacle 72 so as to grip the receptacle. The arm 26 is raised, the turret 24 is rotated by actuator 13 and the arm 26 is extended or retracted so that the receptacle 72 is positioned over dumpster on the trailer 32 in a second position, as shown in FIG. 3. The dump motor 57 may then be rotated approximately 180 degrees about pivot point 58 to invert the receptacle 72 and empty the receptacle contents into the trailer 32. The method may then be reversed to return the receptacle 72 to a third position substantially the same as its original position.

In an exemplary embodiment, and not by way of limitation, the lift arm 26 and fulcrum element 74 comprise a class 1 fulcrum linear beam with a 7" cantilever offset. A particular embodiment may comprise square steel tubing and a sliding inner boom. In combination, lift arm 26 and extension arm 26*b* may extend beyond edge of platform 20 between six and twelve feet, depending on the extension position of extension arm 26*b*. Furthermore, the lift arm 26 and extension arm 26*b* may, in combination, reach a height of approximately ten feet. In one particular embodiment, grabber 30 may extend between thirty-six and sixty inches beyond platform 20.

In another implementation, the vehicle 100 includes a transport rail 124 and a carrier 126, as shown in FIGS. 5-8. On the platform 120 of the vehicle 100 is mounted a front rail support 123 and a rear rail support 125. The transport rail 124 is mounted to the front rail support 123 and the rear rail support 125. The rear end of the transport rail 124 is suspended above the trailer 32. The carrier 126 is configured to travel along the transport rail 124. The front rail support 123 includes an extension arm 128. Particular components of the vehicle 100 used for this particular example will be discussed in further detail below.

Figure 8:
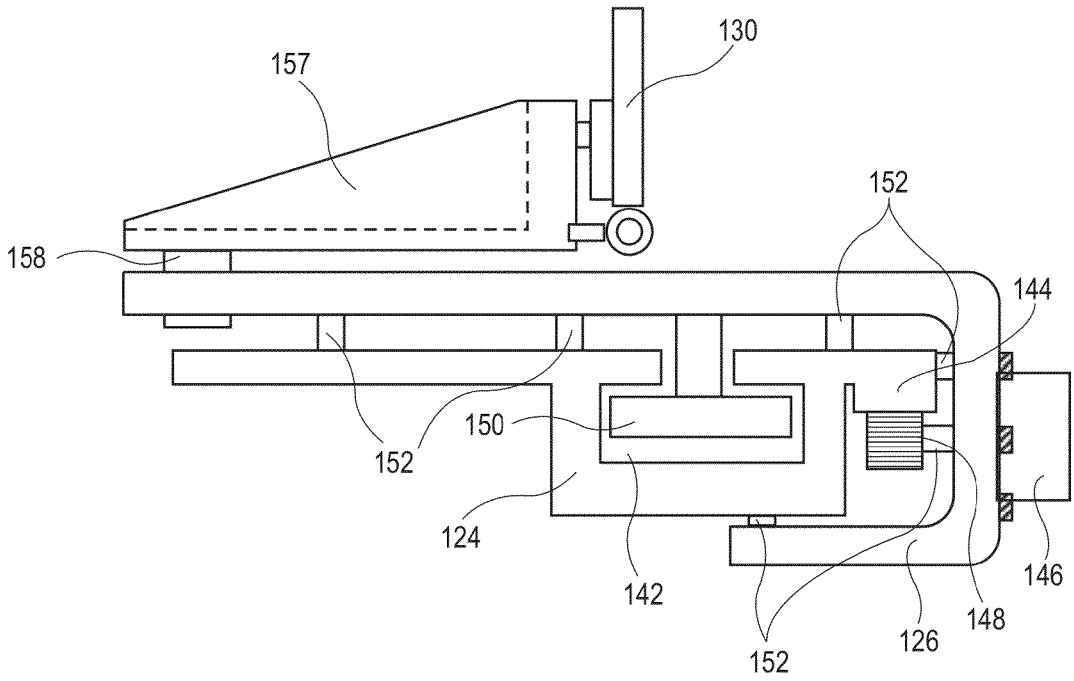
FIG. 8 is a cross sectional view of the transport rail and the carrier taken along sectional line 8-8 in FIG. 5.

The carrier 126 and transport rail 124 are depicted in more detail in FIG. 8. The transport rail 124 forms a traveler well 142 and a traveler wheel 150 is disposed therein. A carrier track 144 is attached to the transport rail 124 and a drive gear 148 is attached to the carrier 126. A motor 146 is attached to the drive gear 148. The carrier 126 also includes several roll bearings 152. Ultra High Molecular Weight Polyethylene (UHMW) may be used as a substitute. The grabbers 130 are attached to a dump plate 157 and the dump plate 157 is attached to the carrier 126 at pivot point 158. The grabbers 130 may be moved between the open position and the closed position around pivot point 155.

Figure 6:
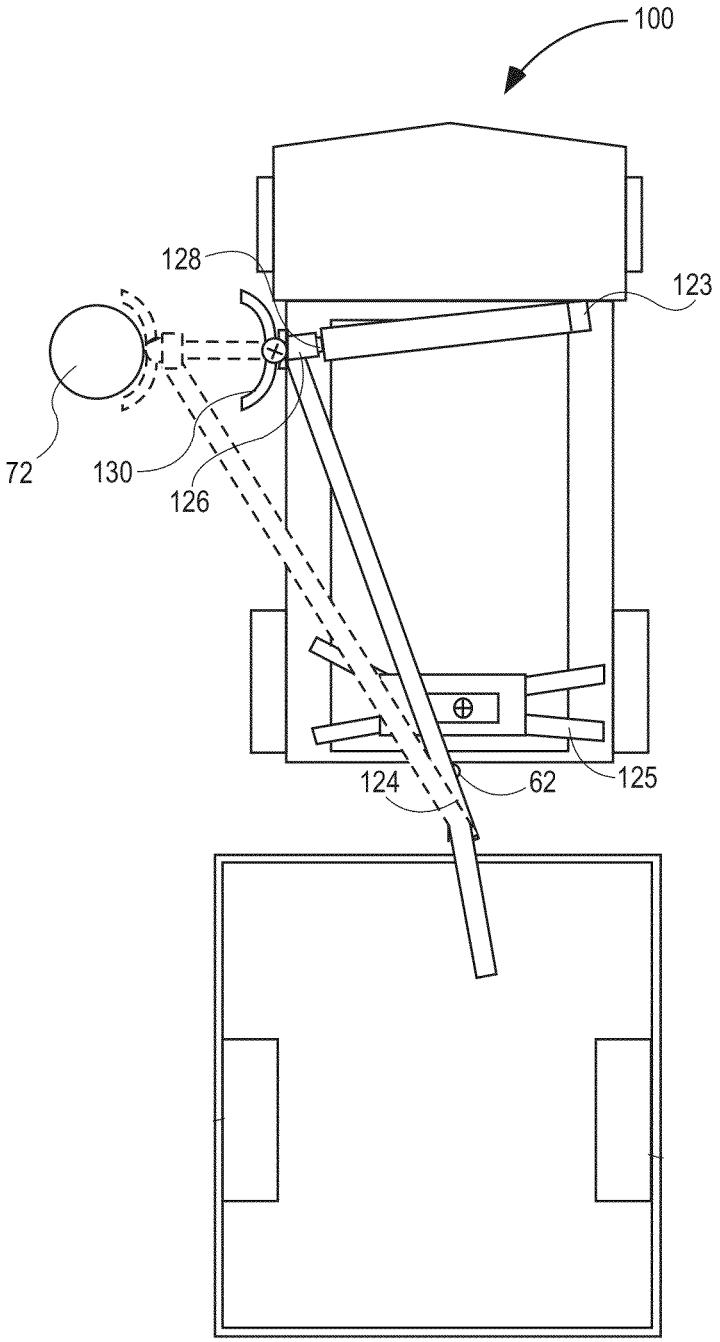
FIG. 6 is a top view of the vehicle from FIG. 5, where the transport rail system is in a first position.
Figure 7:
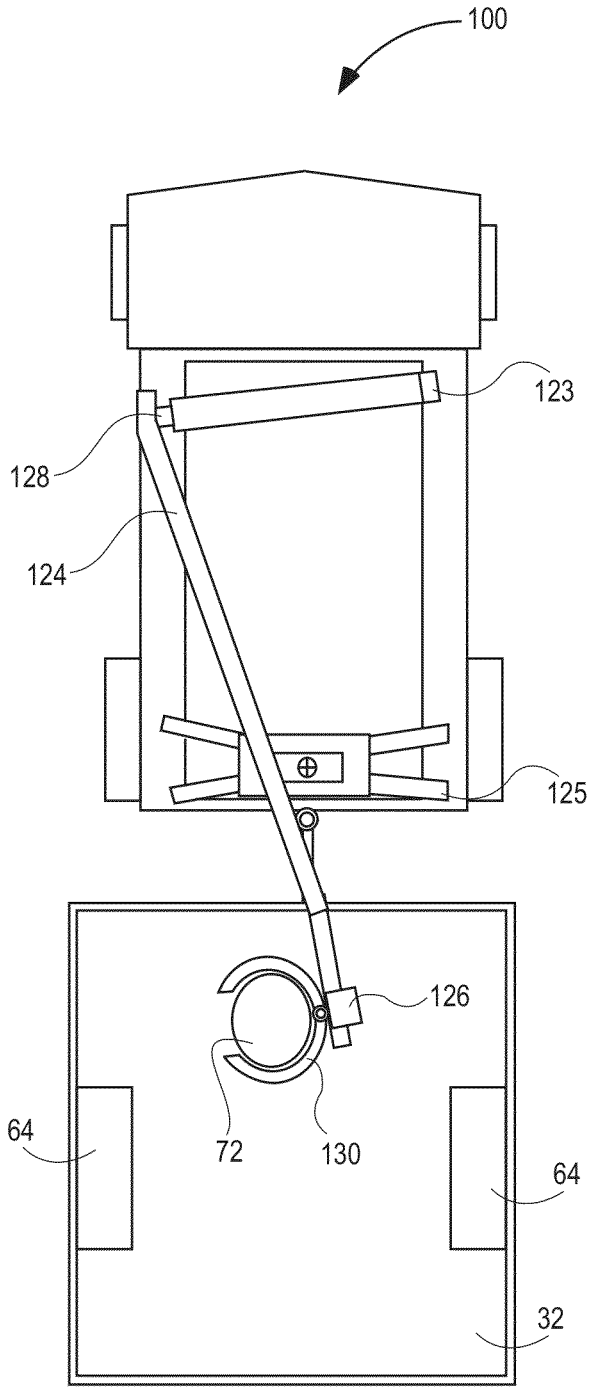
FIG. 7 is a top view of the vehicle from FIG. 5, where the transport rail system is in a second position.

In operation, the vehicle 100 may be positioned alongside a trash receptacle 72 in a first position so that a horizontal plane of the grabbers 130 is substantially parallel with a horizontal plane of the receptacle 72, as shown by the solid lines in FIG. 6. The extension arm 128 extends and lowers the grabbers 130 so that the grabbers 130 are adjacent to the receptacle 72, as shown in phantom in FIG. 6. After gripping the receptacle, the extension arm 128 may be retracted and then the carrier 126 may travel along the transport rail 124 until the receptacle is positioned over the trailer 32 in a second position, as shown in FIG. 7. For this particular example, the motor 146 on the carrier 126 turns the drive gear 148, propelling the carrier 126 along the carrier track 144. The traveler wheel 150 bears most of the weight of the receptacle 72. With the receptacle 72 in position above the trailer 32, the dump plate may be rotated 180 degrees around pivot point 158 to the dumping position, thereby emptying the contents of the receptacle 72. The method is then reversed to return the receptacle 72 to a third position that is substantially the same as its original position.

Figure 11A:
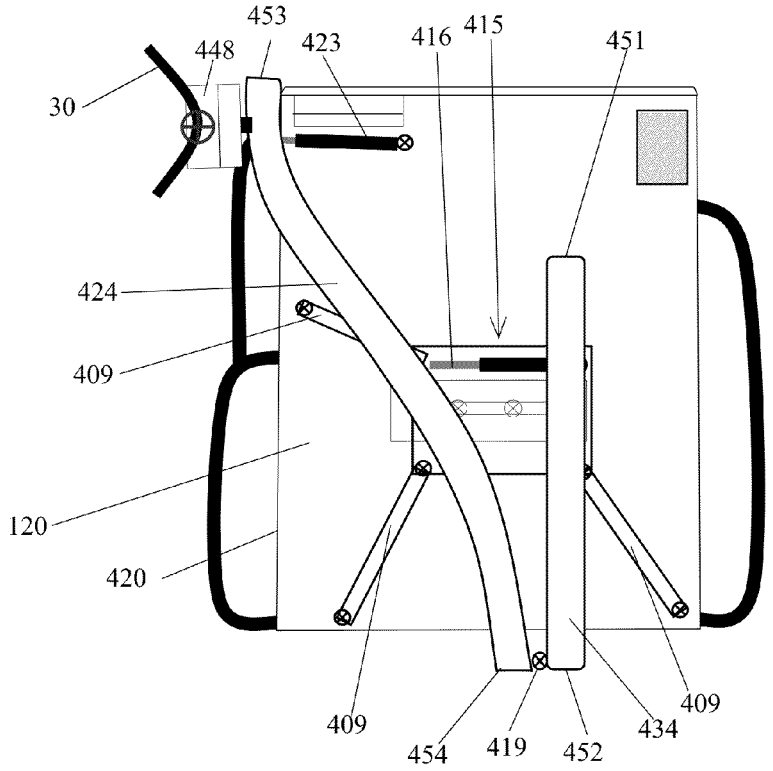
FIG. 11A is a top view of a platform, transport rail, and extension transport rail in a folded position.
Figure 11B:
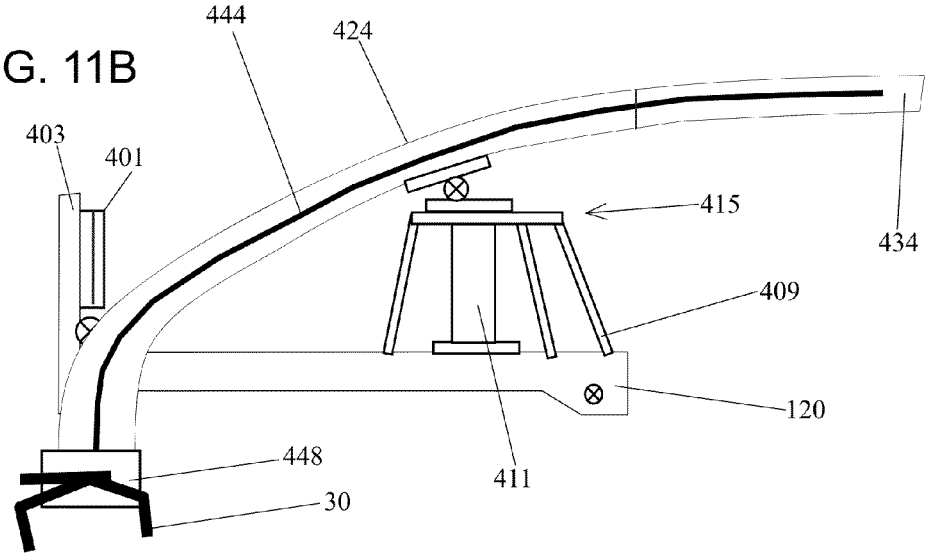
FIG. 11B is a side view of a platform, transport rail, and extension transport rail in an extended position.

In another embodiment, shown in FIGS. 11A and 11B, a platform 120 similar to other platforms described herein is configured to couple to a utility vehicle. In any of the embodiments described herein, bed connecting pins 402, such as those shown in FIG. 4, may be utilized in coupling a platform to a vehicle. As shown in FIG. 11A, platform 120 comprises four sides 420. Other embodiments, however, are not limited to a platform 120 with four sides 420 and may, alternatively, comprise any number of sides 420. In the embodiment shown in FIG. 11A, the four sides 420 of platform 120 comprise a first side, a second side adjacent the first side, a third side adjacent the second side and opposite the first side, and a fourth side adjacent the first and third sides and opposite the second side.

An embodiment may further comprise a first rail support 423 coupled to platform 120. First rail support, in various embodiments, comprises a hydraulic cylinder configured to extend and retract. In the embodiment shown in FIG. 11A, first rail support 423 is coupled to platform 120 and curved transport rail 424. In other embodiments, however, first rail support 423 may be coupled to the first side of the four sides 420 or the headboard 403. When extended, the hydraulic cylinder of the first rail support 423 pushes the first end 453 of curved transport rail 424 away from the first side of platform 120. And when retracted, the hydraulic cylinder of the first rail support 423 draws the first end 453 closer to the first side of platform 120.

The embodiment shown in FIGS. 11A and B further comprises a second rail support 415 coupled to platform 120 and curved transport rail 424. Various embodiments of the second rail support 415 may comprise a raised support platform substantially parallel to platform 120 and be supported by center support 411 and a plurality of side supports 409 that extend between platform 120 and the raised support platform. A hydraulic cylinder 416 may also be included in some embodiments, the hydraulic cylinder 416 being coupled to the transport rails 424 and the second rail support 415. Hydraulic cylinder 416 is configured to extend and retract, thus effectuating movement of the transport rail 424 when extending or retracting.

Curved transport rail 424 may be configured of similar parts and components to transport rail 124, with any exceptions described herein. As shown in FIG. 11A, curved transport rail 424 is curved when viewed from above the platform 120. In such an embodiment, a first end 453 of the curved transport rail 424 is positioned proximate the first side of the four sides, while the second end 454 of the curved transport rail 424 is positioned proximate the fourth side of the four sides, between the first and third sides. In some embodiments, the second end 454 of the curved transport rail 424 extends through a plane formed by the fourth side of the four sides 420, while in other embodiments, the second side 454 of curved transport rail 424 only approaches the plane formed by the fourth side of the platform 120. In still other embodiments, curved transport rail 424 may alternatively comprise a substantially straight transport rail (similar to 124) that begins proximate the first side of the four sides and ends proximate the fourth side between the first and third sides of the four sides 420 of platform 120.

As illustrated in FIG. 11B, curved transport rail 424 may also be curved when viewed from the first side of the four sides 420. In the embodiment shown in FIG. 11B, the first end 453 of curved transport rail 424 is positioned below platform 120, and the second end 454 of curved transport rail 424 is positioned above platform 120. In other embodiments, however, the first end 453 of transport rail 424 may be substantially level with platform 120 or even above platform 120. In still other embodiments, curved transport rail 424 may comprise a continuously sloped rise from the first end 453 to the second end 454.

An embodiment further comprises a transport rail extension 434 hingedly coupled to the second end 454 of curved transport rail 424 at hinge 419. Transport rail extension 434 is pivotal between a folded position (shown in FIG. 11A) and an extended position (shown in FIG. 11B). In the folded position, the terminating end 451 of the transport rail extension 434 is positioned over platform 120 and first end 452 of the transport rail extension 434 does not abut the second end 454 of transport rail 424. In an extended position, as shown in FIG. 11B, the first end 452 of transport rail extension 434 substantially abuts the second end 454 of transport rail 424 and the terminating end 451 is positioned beyond platform 120—not over platform 120. Furthermore, in an extended position, curved transport rail 424 and transport rail extension 434 from a continuous rail that allows the grabber to move from the first end 453 of curved transport rail 424 to the terminating end 451 of the transport rail extension 434. When grabber 30 is proximate the terminate end 451 of transport rail extension 434, grabber 30 is, in some embodiments, positioned over a trailer coupled to platform 120. The trailer may comprise any trailer described herein or other trailers known in the art. A particular embodiment utilizes a ⅛" thick UHMW to lower the coefficient of friction between the sliding grabber backing 448 and the curved transport rail 424 and transport extension rail 434.

Movement of grabber 30 may be along track 444, the track 444 comprising any slot, channel, groove, protrusion, or other configuration that allows for grabber backing plate 448 to move along curved transport rail 424 and transport rail extension 434. Grabber 30 may comprise any grabbers disclosed herein or otherwise known in the art. In some embodiments, a sanitizer spraying element similar to that described elsewhere in this document may be positioned on grabber 30.

In particular embodiments utilizing transport rails 124, 424 or variations thereof, grabber 30 may extend eighty-four inches beyond the platform 120 when locked in the work or extended position. In the transport position, the grabber 30 may extend approximate twelve inches beyond the platform 120.

In all of the examples discussed above, the moving components are controlled by an operator or through a preprogrammed processor initiated by the operator at controllers located in the cab 14 of the vehicle 10 or 100. The moving components, such as the extension arm 26, grabbers 30 and 130, carrier motor 146, dump plates 57 and 157, and others are manipulated by power assist devices such as hydraulic or pneumatic cylinders, electric or hydraulic motors, or cable and pulley arrangements, as are known in the art, to control articulation of the components. In particular implementations of the refuse vehicles described in this disclosure, a proportional hydraulic system may be used for smoother transitions. The power controller is located in the cab 14 to the right of the operator not specifically illustrated. The controller is connected to through conduits or wireless connections to the hydraulic component VB 92 located at the headboard of platform 20 as shown in FIGS. 1-3. In the particular examples discussed above, the grabbers 30 and 130 are two-armed grabbers for gripping round objects. However, other type of grabbers may alternatively be used, such as forklift, clamshell or claw shaped grabbers or drag pulleys. In a particular implementation, a brush grabber attachment is utilized for scooping up piles of refuse outside of receptacles, loose bags or landscape waste such as piles of brush.

Figure 9A:
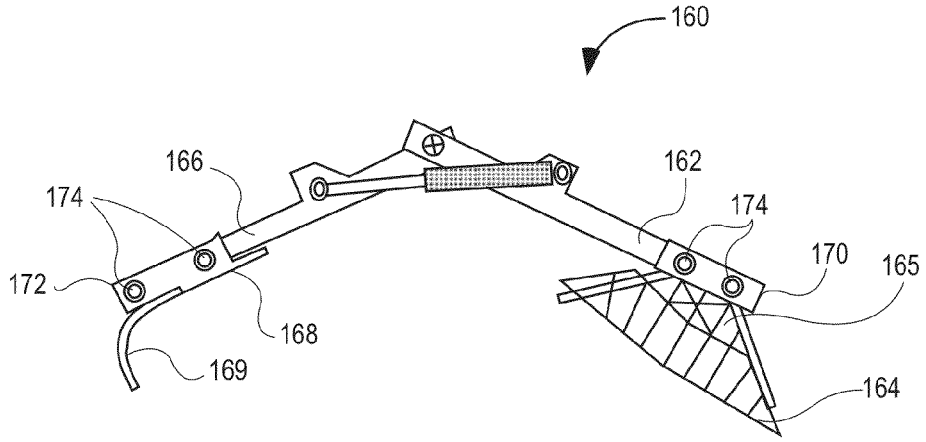
FIGS. 9*a*, 9*b* and 9*c* are views of an optional brush grabber tool for attachment to the grabber arms.
Figure 9B:
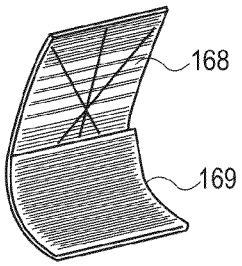
Figure 9C:
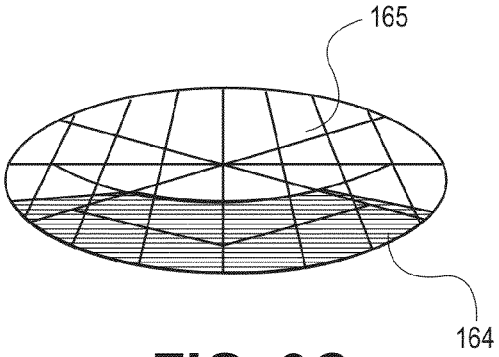

For this particular implementation, the each grabber arm is configured for optional attachment to one or more auxiliary components or tools for added functionality. For example, as shown in FIGS. 9A, 9B and 9C, a first arm 162 of the grabber 160 is configured for attachment to a stainless steel dish scoop 164 with a reinforced wire mesh top portion 165, and a second arm 166 of the grabber 160 is configured for attachment to a pan scoop 169 with a reinforced lightweight screen top portion 168. Working together, the dish scoop 164 and the pan scoop 169 can pick up a pile of debris on the ground next to the vehicle prior to transporting it for dumping in the trailer. The dish scoop 164 and pan scoop 169 are configured for attachment to the grabber arms 162 and 166 through sleeves 170 and 172 that slide over the end of the grabber arms. Pins 174 may be inserted into openings in the sleeves and the grabber arms to attach the sleeves to the arms. This is just one specific example of a tool that may be configured for attachment to the grabber arms for increased functionality. Other tool configurations may include, without limitation, hooks for carrying brush sacks, a scoop or a plow for pushing gravel or landscaping material as the vehicle moves, and a broom or blower attachment for cleaning walkways of debris as the vehicle moves.

In particular embodiments of the invention, the grabber arm, whether on a transport rail-type system or a lift-arm type system, may include laser guided programming to further simplify the operation of the vehicle for the user. Using multiple distance sensing lasers located on or associated with grabbers 30 or 130, and a programmable computer, the small refuse vehicle becomes fully automated. For example, an arm may include two sensors, one sensing the arm's height from the ground and the other mounted on the grabber, sensing distances from the receptacle or target. When the arm is active, a laser may sense contact with the ground and within three feet of the target. The closer the arm gets to its target, the stronger the signal becomes, continuously relaying information to the computer. Once the equipment operator reaches a point close to the receptacle, such as within three (3) feet, the computer program may be activated to grab the receptacle.

In earlier implementations or on the laser implementations, portions or all of the refuse dump process may be automated such that other than pressing a button or otherwise initiating a start process, the operator does not need to manually move any controls until the process is completed. The operator does not need to move the can off of the ground, transport the can up and over the trailer for dumping, return the can, place the can back on the ground, open the grabber, or return the grabbers back to the rest position. An additional automated shake of the can may optionally be added during the dumping step. The driver may then move to the next can and move the arm toward the can.

Figure 13:
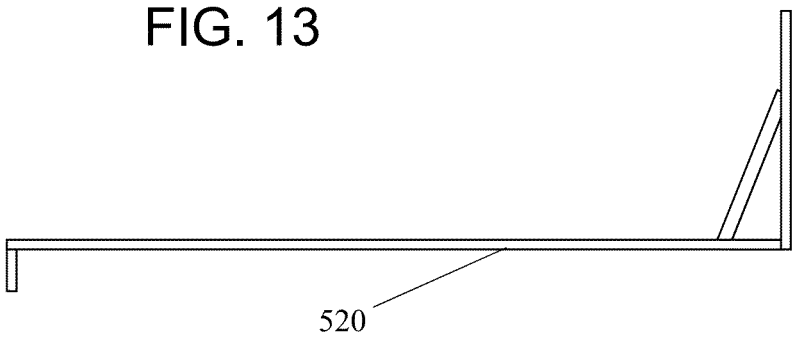
FIG. 13 is a side view of a platform bed surface.

Also contemplated is a utility bed system for use with a utility vehicle and the refuse receptacle emptying apparatuses disclosed herein, as shown in FIGS. 13-17. FIG. 13 illustrates a side view of a refuse bed surface 520, similar to platforms 20 and 120 previously described. In one particular embodiment that may be utilized as platform 20 or 120, refuse bed surface is approximately four feet wide and five feet long, and constructed of approximately ⅛" diamond plate steel.

Figure 14:
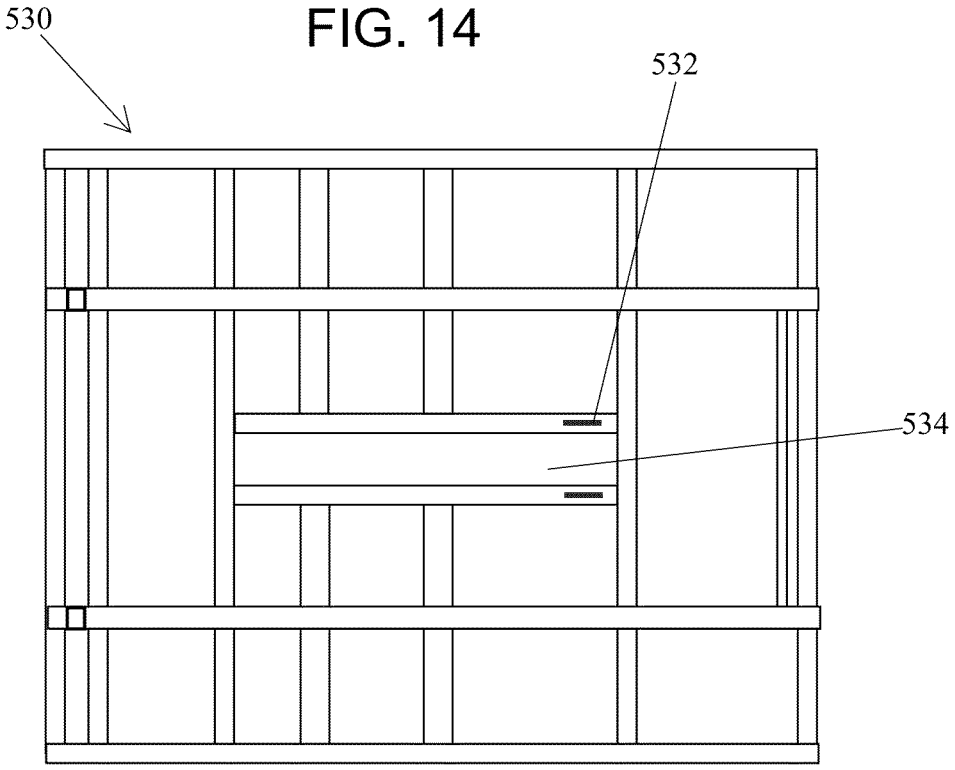
FIG. 14 is a top view of a bed support structure.
Figure 15A:
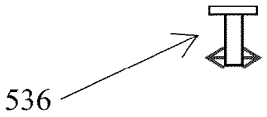
FIG. 15A is a side view of a hinge pin.
Figure 15B:
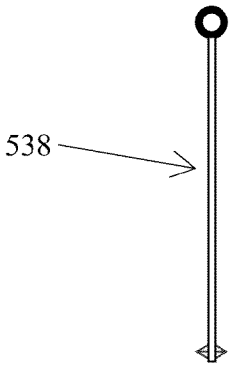
FIG. 15B is a side view of a lock down pin.
Figure 16A:
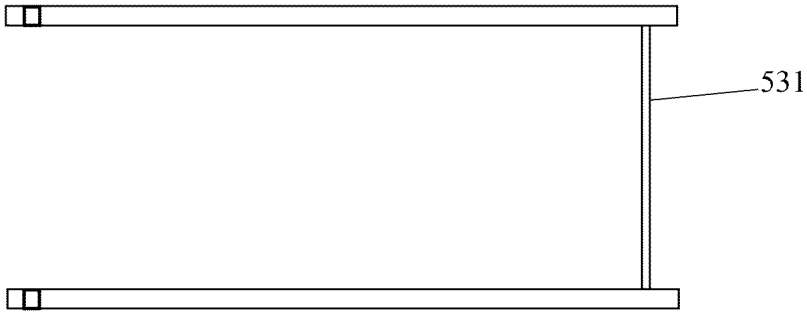
FIG. 16A is a top view of a tilt frame.
Figure 16B:
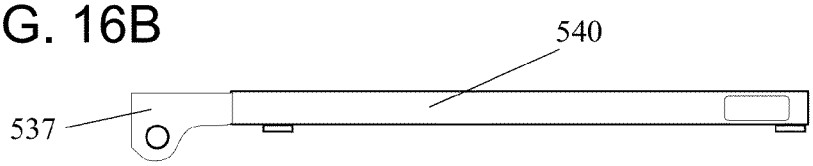
FIG. 16B is a side view of a tile frame.
Figure 16C:
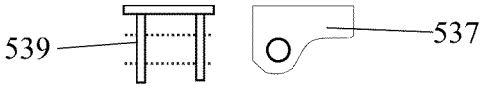
FIG. 16C is a side view of tilt frame components.
Figure 16D:
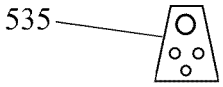
FIG. 16D is a side view of a lockdown plate.

FIG. 14 illustrates a support structure 530 with a hydraulic actuator aperture 534 and slots 532 for actuator pins. FIG. 15A illustrates a rear hinge pin 536 that may be utilized in a system to couple a vehicle chassis 550 to support structure 530. FIG. 15B illustrates a front lock down pin 538 that may be utilized in a system to couple a vehicle chassis 550 to support structure 530. FIG. 16A illustrates a top view of the frame rails 531 of tilt frame 540. FIG. 16B illustrates a side view of tilt frame 540. FIG. 16C illustrates a supports structure 539 to chassis rear hinge bracket 537, and FIG. 16D illustrates a chassis frame front lockdown plate 535.

Figure 17:
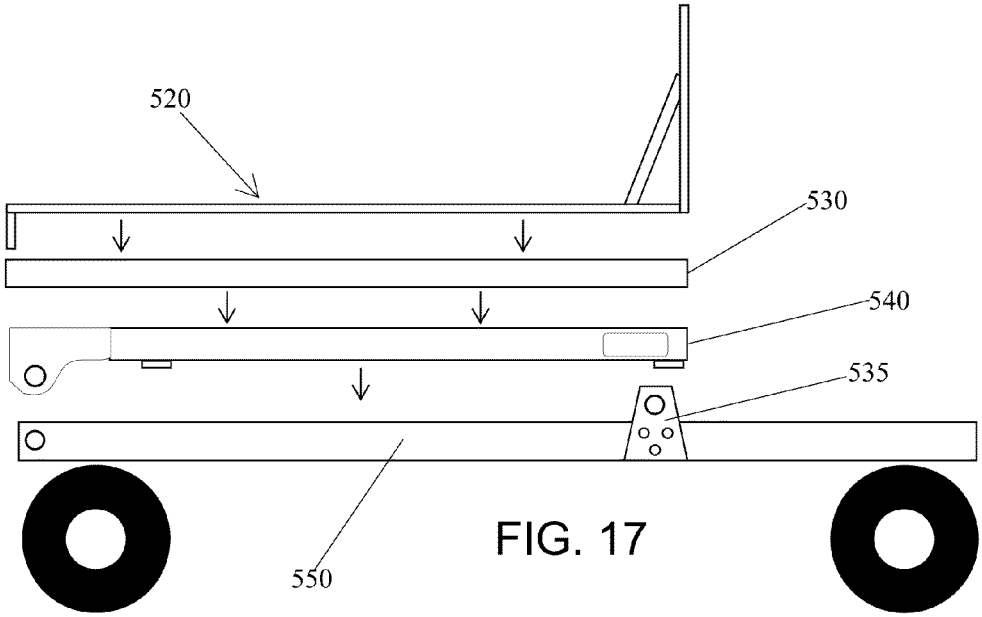
FIG. 17 is an exploded view of a platform and vehicle chassis assembly.

FIG. 17 illustrates an exemplary embodiment for coupling the parts described above together. Tilt frame 540 is coupled to vehicle chassis 550 utilizing front lockdown plate 535. Support structure 530 is coupled of tilt frame 540, and platform 520 is coupled over support structure 530. In an embodiment, these parts together provide a unit pivotally coupled to vehicle chassis 550. Together, the system typically comprises four points of connection with the vehicle chassis 550.

Figure 18A:
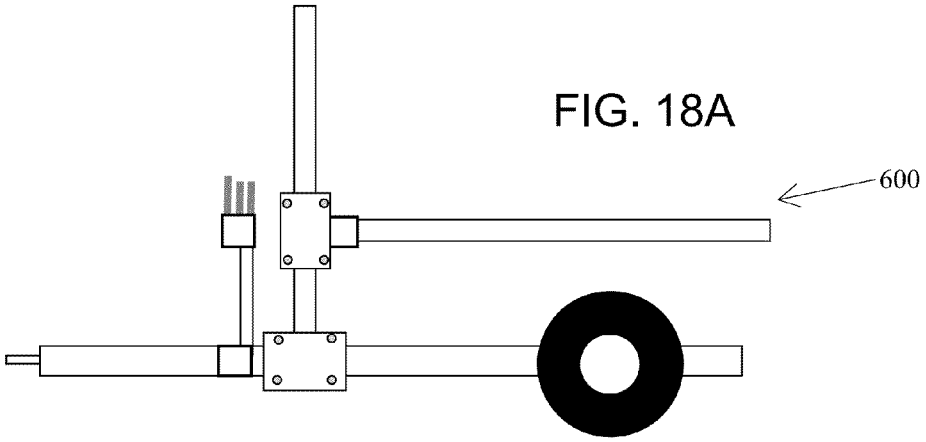
FIGS. 18A-C are sides views of a hauler in various positions.
Figure 18B:
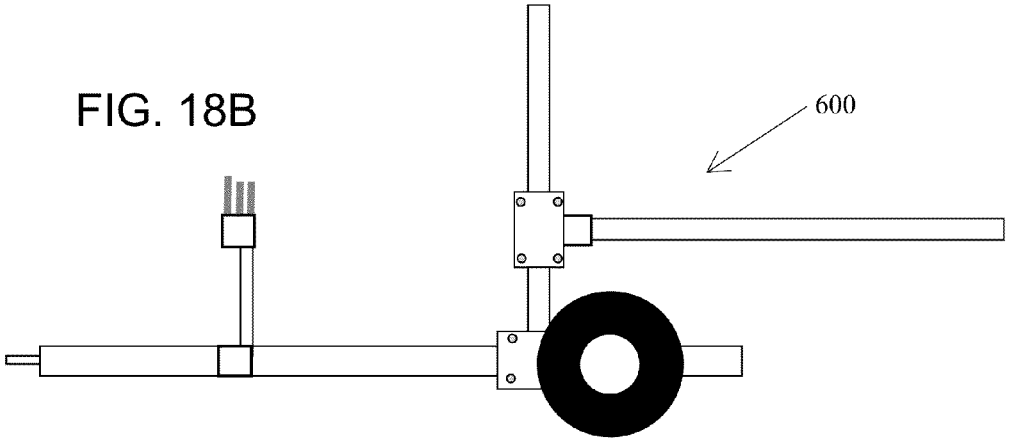
Figure 18C:
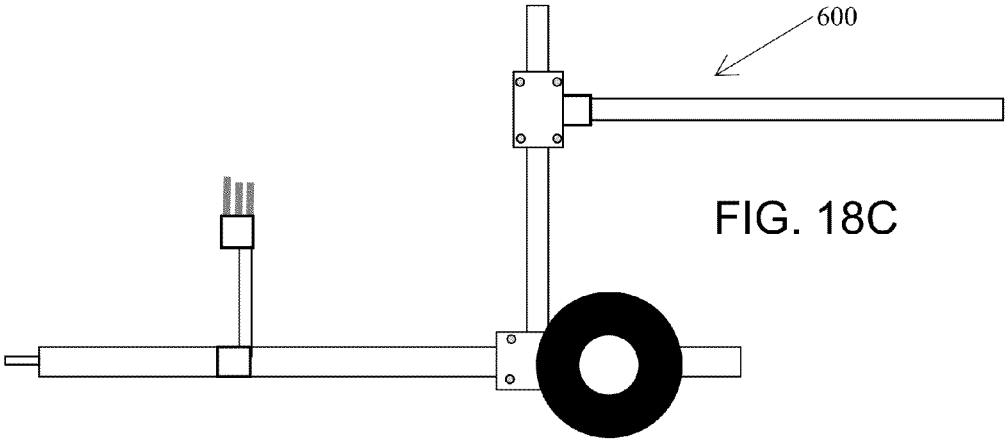

Also contemplated is a portable dumpster hauler, as similarly shown in FIG. 2. In an embodiment, dumpster hauler 600 is positionable between a transport position and an extended position. FIG. 18A illustrates a portable dumpster hauler in a transport position, while FIGS. 18B and C illustrate a portable dumpster hauler in an extended position. In FIG. 18B, the portable dumpster hauler is in a low extended position that allows for loading of a grounded dumpster. In FIG. 18C, the portable dumpster is in an extended raised positioned that lifts the dumpster. In an embodiment, the portable dumpster hauler comprises one or more roller tracks and lift arms configured to grip a dumpster and draw it into the trailer across the roller track for transport to a different location. Typical dumpster utilized with the portable dumpster hauler may hold approximately eight yards, although other sized dumpsters, such as two yard, four yard, six yard, etc., may be utilized without departure from the aspects disclosed herein.

Figure 19:
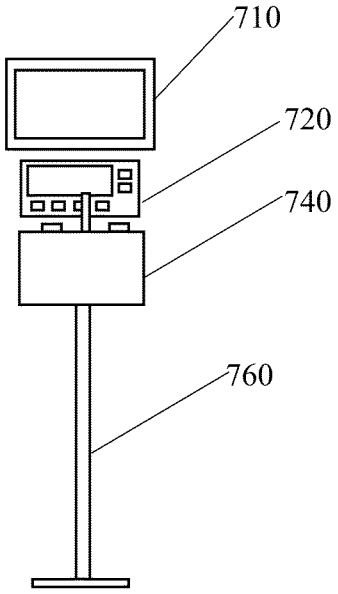
FIG. 19 is a side view of a computerized control system.

Also contemplated herein is a computerized control system for use with any of the disclosures discussed herein. An exemplary system is shown in FIG. 19. In an embodiment, the computerized control system comprises one or more of a multi-camera video monitor 710, a six function computer controller 720, a computer override controller 740, and/or a cab operator control station pedestal 760. Various embodiments of the apparatus or systems disclosed in the document in its entirety may comprise at least one of these aspects of the computerized control system. A computer system like or similar to that shown in FIG. 19 may be configured to utilize embodiments presented herein to collect and empty trash receptacles directly into a dumpster being bulled behind the vehicle.

In a particular embodiment, systems comprising the lift arm 26 or transport rails 124, 424 are approximately six feet wide and seven feet tall, including the utility vehicle. This allows the vehicle to pass under trees and through low or narrow tunnels common in parks and golf courses. In particular embodiments, the height systems comprising the lift arm 26 or transport rails 124, 424 is between thirty-two inches and forty-one inches.

Various embodiments of the systems and apparatuses disclosed herein utilize a battery. Although the systems may be configured to use any battery, particular embodiments utilize a 12 volt DC battery. Moreover, as described throughout this document, hydraulic power may be utilized in various components, such as hydraulic cylinders previously references.

This paragraph describes a more specific detailed example of how a particular embodiment may be implemented. A 12 volt DC and hydraulic powered trailer, automated arm or refuse transport rail system, trash dumpster, and vehicle are provided. The automated arm, where used, includes a class 1 fulcrum linear beam with a 7 inch cantilever offset. The automated arm is constructed of a square steel tubing and contains a sliding inner boom. The automated arm reaches beyond the edge of the vehicle body greater than 6 feet with an overall extension of less than 12 feet. The automated arm body (where used) has a vertical reach of approximately 10 feet. The horizontal transport rail body (where used) has a vertical reach of approximately 8 feet. A horizontal transport rail, where used, grips a refuse container and moves it down the rail dumping it in the trash dumpster. The automated arm uses a ⅛ inch thick ultra-high-molecular weight polyethelene material to lower the friction coefficient of the sliding boom. A trash dumpster towed by the vehicle is 4 feet wide and 5 feet long, constructed using approximately ⅛ inch diamond plate steel. The trash dumpster includes a bed, super structure, frame and frame rails, 1½ inch diameter rub rails bolted to each side of the body, four points of connection to the vehicle chassis or full frame and is hinged and lifts upward as a dump bed with a lifting capability of approximately 300 pounds. The automated arm platform weighs less than 1500 pounds total. Due to the size and function of the automated arm, an optimal location for mounting the arm turret is through the super structure. The turret is mounted using ½ inch #8 hardened bolts. The automated arm grabbers grip trash receptacles having a radius of approximately 19 inches to 24 inches in diameter. The automated arm can rotate approximately 270 degrees and retrieve trash receptacles on either side of the vehicle. Programmable logic controllers are used to control the trash dumpster and dump bed by the vehicle operator. The trailer is configured to receive any 2, 4, 6 or 8 yard conventional dumpster to make it portable. The trailer has two sources of hydraulic power, 12V DC standalone, or connected to the vehicle. The trailer, like the vehicle, operates with either standard tires or flotation tires. The trailer is configured so that it can alternatively be towed behind a truck.

The implementations and examples set forth herein are presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the invention. The presently disclosed implementations are, therefore, to be considered in all respects as illustrative and not restrictive, the scope of the disclosure being indicated by the appended claims rather than the foregoing description. All changes that come within the meaning and range of equivalency of the claims are intended to be embraced therein.

The invention claimed is:

1. A refuse receptacle emptying apparatus for use with a utility vehicle, comprising:

a platform configured to couple to a utility vehicle;

a turret rotatably coupled to the platform, the turret responsive to a turret actuator pivotally coupled to the turret and the platform that rotates the turret between a first position and a second position;

a fulcrum element pivotally coupled to the turret;

a substantially hollow lift arm coupled to the fulcrum element, the fulcrum element positioned between a first end of the lift arm and a second end of the lift arm such that when the first end of the lift arm is lowered the fulcrum element pivots to raise the second end of the lift arm and when the first end of the lift arm is raised the fulcrum element pivots to lower the second end;

an extendable lift cylinder pivotally coupled to the turret proximate the platform and pivotally coupled proximate the first end of the lift arm, the extendable lift cylinder configured to raise the first end of an extension arm relative to the platform when extended and lower the first end of the extension arm relative to the platform when retracted;

the extension arm being a telescoping extension arm slidably coupled at least partially within the lift arm and extendable from the second end of the lift arm responsive to an extension cylinder coupled to the extension arm and the lift arm;

a grabber pivotally coupled to the extension arm, wherein the grabber is coupled to a grabber backing plate pivotally coupled to the extension arm, the grabber comprising two curved grabber elements each movably coupled to the grabber plate;

a bag collector arm pivotally coupled to the extension arm and responsive to a bag collector motor to pivot between a retracted collector arm position and an extended collector arm position; and a receptacle leveling actuator coupled to the grabber backing plate.

2. The apparatus of claim 1, wherein the extension arm extends and retracts at least partially within the lift arm responsive to a extension cylinder that extends into the second end of the lift arm.

3. The apparatus of claim 1, further comprising a sanitizer spraying element coupled the grabber backing plate.

4. A utility vehicle for gathering refuse from refuse receptacles, comprising:

a utility vehicle chassis comprising a width less than about 72 inches four steerable tires comprising a width greater than about 12 inches, each of the four steerable tires operably coupled to the utility vehicle chassis, the vehicle comprising a vehicle length of between about 80 inches and 130 inches, and a gross vehicle weight of less than about 4200 pounds;

a platform coupled the vehicle chassis, the platform comprising a first side, a second side adjacent the first side, a third side adjacent the second side and opposite the first side, and a fourth side adjacent the third and first sides and opposite the second side;

an arm coupled to platform, the arm comprising a grabber movable between a first position proximate the first side of the platform and a second position past the fourth side of the platform, the grabber configured to grip a refuse receptacle having a capacity between approximately 30 and 60 gallons;

a trailer coupled to the platform proximate the fourth side of the platform, wherein when the grabber is in the second position the grabber is positioned over the trailer, wherein the trailer comprises a chassis comprising a roller track and lift arms configured to grip a dumpster and draw the dumpster into the trailer across the roller track for transport to a different location.

5. The vehicle of claim 4, wherein the arm comprises a lift arm and the vehicle further comprises:

a turret rotatably coupled to the platform;

a fulcrum element pivotally coupled to the turret and coupled to the lift arm between a first end of the lift arm and a second end of the lift arm such that when the first end of the lift arm is lowered the fulcrum element pivots to raise the second end of the lift arm and when the first end of the lift arm is raised the fulcrum element pivots to lower the second end;

an extendable lift cylinder pivotally coupled to the turret and pivotally coupled proximate the first end of the lift arm, the extendable lift cylinder configured to raise the first end of an extension arm relative to the platform when extended and lower the first end of the extension arm relative to the platform when retracted; and the extension arm slidably coupled to the lift arm and extendable from the second end of the left arm;

wherein the grabber is pivotally coupled to the extension arm and the turret is responsive to a turret actuator coupled to the turret and the platform to rotates the grabber between the first position and the second position.

6. The apparatus of claim 5, wherein the extendable lift cylinder is pivotally coupled to the turret proximate the platform and the turret actuator is pivotally coupled to the platform and pivotally coupled to the turret.

7. The apparatus of claim 4, wherein the arm comprises a curved transport rail comprising a first end proximate the first side of the platform and a second end raised above the platform relative the first end and positioned proximate the fourth side, the vehicle further comprising:

a first rail support extensions cylinder coupled to the platform and the curved transport rail and configured to move the first end of the curved transport rail further from and closer to the first side;

a second rail support coupled to the platform and the curved transport rail; and a transport rail extension hingedly coupled to the second end of the transport rail, the transport rail extension pivotal between a folded position and an extended position responsive to an actuator;

wherein the grabber is movable along the transport rail and the transport rail extension between the first position proximate the first end of the transport rail and the second position proximate a terminating end of the transport rail extension when the transport rail extension is in a extended position.

8. A refuse receptacle emptying apparatus for use with a utility vehicle, comprising:

a platform configured to couple to a utility vehicle;

a turret rotatably coupled to the platform, the turret responsive to a turret actuator pivotally coupled to the turret and the platform that rotates the turret between a first position and a second position;

a fulcrum element pivotally coupled to the turret;

a substantially hollow lift arm coupled to the fulcrum element, the fulcrum element positioned between a first end of the lift arm and a second end of the lift arm such that when the first end of the lift arm is lowered the fulcrum element pivots to raise the second end of the lift arm and when the first end of the lift arm is raised the fulcrum element pivots to lower the second end;

a telescoping extension arm slidably coupled at least partially within the lift arm and extendable from the second end of the lift arm responsive to an extension cylinder coupled to the extension arm and the lift arm;

an extendable lift cylinder pivotally coupled to the turret proximate the platform and pivotally coupled proximate the first end of the lift arm, the extendable lift cylinder configured to raise the first end of the extension arm relative to the platform when extended and lower the first end of the extension arm relative to the platform when retracted;

a grabber pivotally coupled to the extension arm, wherein the grabber is coupled to a grabber backing plate pivotally coupled to the extension arm, the grabber comprising two curved grabber elements each movably coupled to the grabber plate;

a bag collector arm pivotally coupled to the extension arm and responsive to a bag collector motor to pivot between a retracted collector arm position and an extended collector arm position; and a sanitizer spraying element coupled the grabber backing plate.

9. The apparatus of claim 8, wherein the extension arm extends and retracts at least partially within the lift arm responsive to a extension cylinder that extends into the second end of the lift arm.

* * * * *